US010777907B2

(12) United States Patent
Woolrich et al.

(10) Patent No.: US 10,777,907 B2
(45) Date of Patent: Sep. 15, 2020

(54) ANTENNA HORN, ANTENNA, AND ANTENNA ARRAY FOR A RADIATING PRINTED CIRCUIT BOARD, AND METHODS THEREFOR

(71) Applicant: The Boeing Company, Chicago, IL (US)

(72) Inventors: Kyle A. Woolrich, El Segundo, CA (US); Jay Stuart Spence, Hermosa Beach, CA (US); Shihchang Wu, Rancho Palos Verdes, CA (US)

(73) Assignee: The Boeing Company, Chicago, IL (US)

( * ) Notice: Subject to any disclaimer, the term of this patent is extended or adjusted under 35 U.S.C. 154(b) by 204 days.

(21) Appl. No.: 16/108,401

(22) Filed: Aug. 22, 2018

(65) Prior Publication Data

US 2020/0067199 A1 Feb. 27, 2020

(51) Int. Cl.
*H01Q 13/00* (2006.01)
*H01Q 21/06* (2006.01)
(Continued)

(52) U.S. Cl.
CPC ..... *H01Q 21/064* (2013.01); *H01Q 13/06* (2013.01); *H01Q 21/08* (2013.01); *H01Q 21/24* (2013.01); *H01Q 1/38* (2013.01)

(58) Field of Classification Search
CPC ..... H01Q 21/064; H01Q 21/24; H01Q 21/08; H01Q 13/06
See application file for complete search history.

(56) References Cited

U.S. PATENT DOCUMENTS 6,271,799 B1 * 8/2001 Rief ..... H01Q 13/0258 343/776
7,077,658 B1 7/2006 Ashman et al.
(Continued)

FOREIGN PATENT DOCUMENTS

DE 102008026732 12/2009

OTHER PUBLICATIONS

European Search Report dated Dec. 10, 2019; European Application No. EP19191881.2.

(Continued)

*Primary Examiner* — Dieu Hien T Duong
(74) *Attorney, Agent, or Firm* — Perman & Green LLP

(57) ABSTRACT

An antenna array including a printed circuit board having a plurality of printed circuit board launchers, and an array of antenna horns configured to couple with the printed circuit board, one or more antenna horns of the array of antenna horns includes a frame having at least one aperture forming a cup structure that circumscribes a respective printed circuit board launcher, the frame having a first end coupled to the printed circuit board and a second end longitudinally spaced from the first end and extending from the printed circuit board, and a plurality of compliant coupling members extending longitudinally from the first end, the plurality of compliant coupling members being coupled with respective receiving apertures of the printed circuit board such that coupling of plurality of compliant coupling members and the respective receiving apertures solely couples the one or more antenna horns to the printed circuit board.

20 Claims, 16 Drawing Sheets

(51) Int. Cl.

| | |
|---|---|
| ***H01Q 13/06*** | (2006.01) |
| ***H01Q 21/08*** | (2006.01) |
| ***H01Q 21/24*** | (2006.01) |
| *H01Q 1/38* | (2006.01) |

(56) References Cited

U.S. PATENT DOCUMENTS

| | | | | |
|---|---|---|---|---|
| 7,210,969 | B1 * | 5/2007 | Hashimoto | H01R 12/585 439/751 |
| 2009/0066598 | A1 * | 3/2009 | Malstrom | H01Q 21/064 343/786 |

OTHER PUBLICATIONS

Methfessel et al.; "Design of a Balance-Fed Patch-Excited Horn Antenna at Millimeter-Wave Frequencies", Antennas and Propagation (EUCAP), 2010 Proceedings of the Fourth European Conference, IEEE, Piscataway, NJ, USA, Apr. 12, 2010, pp. 1-4.

"Press-Fit Technology" www.te.com/usa-en/products/connectors/automotive-connectors/intersection/press-fit-connections.html?tab=pgp story date retrieved Jun. 14, 2018.

Mattsson, et al. "Press-Fit Technology", www.te.com/content/dam/te-com/documents/automotive/global/whitepaper-pressfit-072014 date retrieved Jun. 13, 2018.

* cited by examiner

ANTENNA HORN, ANTENNA, AND ANTENNA ARRAY FOR A RADIATING PRINTED CIRCUIT BOARD, AND METHODS THEREFOR

BACKGROUND

1. Field

The exemplary embodiments generally relate to antennas and more particularly to antennas having antenna horns.

2. Brief Description of Related Developments

Antennas, such as phased array antennas, generally include antenna horns mounted to a radiating (e.g., propagation of electromagnetic waves) printed circuit board (referred to herein as a "printed circuit board"). Generally, the antenna horns are mounted to the printed circuit board using mounting holes and screws that pass through mounting flanges on the antenna horns so that when fastened to the mounting holes the screws clamp the antenna horns to the printed circuit board. When mounting a large array of antenna horns to the printed circuit board, a radio frequency ground interconnect is generally provided between the antenna horns and the printed circuit board around each printed circuit board launcher. Providing the radio frequency ground interconnect is difficult over a large surface area with many printed circuit board launchers and typically entails the use of an exotic clamping structure that includes the mounting holes for the screws. The exotic clamping structure is bulky, occupies a significant amount of space on the printed circuit board, increases the mass of the phased array antennas, increases the cost of the phased array antennas, and prevents higher density phase arrays with, for example, sub-lambda spacing.

SUMMARY

Accordingly, apparatuses and methods, intended to address at least one or more of the above-identified concerns, would find utility.

The following is a non-exhaustive list of examples, which may or may not be claimed, of the subject matter according to the present disclosure.

One example of the subject matter according to the present disclosure relates to an antenna horn for coupling with a printed circuit board, the antenna horn comprising: a frame having at least one aperture forming a cup structure through which a radio frequency signal passes, the frame having a first end and a second end longitudinally spaced from the first end; and a plurality of compliant coupling members extending longitudinally from the first end, the plurality of compliant coupling members being configured to couple with respective receiving apertures of the printed circuit board such that coupling of plurality of compliant coupling members and the respective receiving apertures solely couples the antenna horn to the printed circuit board.

Another example of the subject matter according to the present disclosure relates to an antenna array comprising: a printed circuit board having a plurality of printed circuit board launchers; and an array of antenna horns configured to couple with the printed circuit board, one or more antenna horns of the array of antenna horns includes a frame having at least one aperture forming a cup structure that circumscribes a respective printed circuit board launcher, the frame having a first end coupled to the printed circuit board and a second end longitudinally spaced from the first end and extending from the printed circuit board, and a plurality of compliant coupling members extending longitudinally from the first end, the plurality of compliant coupling members being coupled with respective receiving apertures of the printed circuit board such that coupling of plurality of compliant coupling members and the respective receiving apertures solely couples the one or more antenna horns to the printed circuit board.

Still another example of the subject matter according to the present disclosure relates to a method for forming an antenna array, the method comprises: positioning an antenna horn of an array of antenna horns relative to a printed circuit board so that the antenna horn circumscribes a respective printed circuit board launcher of the printed circuit board; and coupling the antenna horn of the array of antenna horns to the printed circuit board solely by coupling a plurality of compliant coupling members, extending from a frame of the antenna horn, and respective receiving apertures of the printed circuit board.

Yet another example of the subject matter according to the present disclosure relates to an antenna comprising: a printed circuit board having one or more printed circuit board launchers; and one or more antenna horns configured to couple with the printed circuit board, an antenna horn of the one or more antenna horns includes a frame having at least one aperture forming a cup structure that circumscribes a respective printed circuit board launcher, the frame having a first end coupled to the printed circuit board and a second end longitudinally spaced from the first end and extending from the printed circuit board, and a plurality of compliant coupling members extending longitudinally from the first end, the plurality of compliant coupling members being coupled with respective receiving apertures of the printed circuit board such that coupling of plurality of compliant coupling members and the respective receiving apertures solely couples the antenna horn to the printed circuit board.

Another example of the subject matter according to the present disclosure relates to a method for forming an antenna, the method comprises: positioning an antenna horn relative to a printed circuit board so that the antenna horn circumscribes a printed circuit board launcher of the printed circuit board; and coupling the antenna horn to the printed circuit board solely by coupling a plurality of compliant coupling members, extending from a frame of the antenna horn, and respective receiving apertures of the printed circuit board.

BRIEF DESCRIPTION OF THE DRAWINGS

Having thus described examples of the present disclosure in general terms, reference will now be made to the accompanying drawings, which are not necessarily drawn to scale, and wherein like reference characters designate the same or similar parts throughout the several views, and wherein:

FIG. 1A is a schematic block diagram of an antenna in accordance with aspects of the present disclosure;

FIG. 1B is a schematic block diagram of an antenna array in accordance with aspects of the present disclosure;

FIG. 2A is a perspective top view of an antenna horn of the antenna and antenna array of FIGS. 1A and 1B in accordance with aspects of the present disclosure;

FIG. 2B is a partial perspective bottom view of the antenna horn of FIG. 2A in accordance with aspects of the present disclosure;

FIG. 2C is a partial sectional side view of the antenna horn of FIG. 2A in accordance with aspects of the present disclosure;

FIG. 3A is a perspective top view of an antenna horn of the antenna array in accordance with aspects of the present disclosure;

FIG. 3B is a partial perspective bottom view of the antenna horn of FIG. 3A in accordance with aspects of the present disclosure;

FIG. 3C is a partial sectional side view of the antenna horn of FIG. 3A in accordance with aspects of the present disclosure;

FIG. 4A is a perspective top view of an antenna horn of the antenna and antenna array of FIGS. 1A and 1B in accordance with aspects of the present disclosure;

FIG. 4B is a partial perspective bottom view of the antenna horn of FIG. 4A in accordance with aspects of the present disclosure;

FIG. 4C is a partial sectional side view of the antenna horn of FIG. 4A in accordance with aspects of the present disclosure;

Figure 1A:
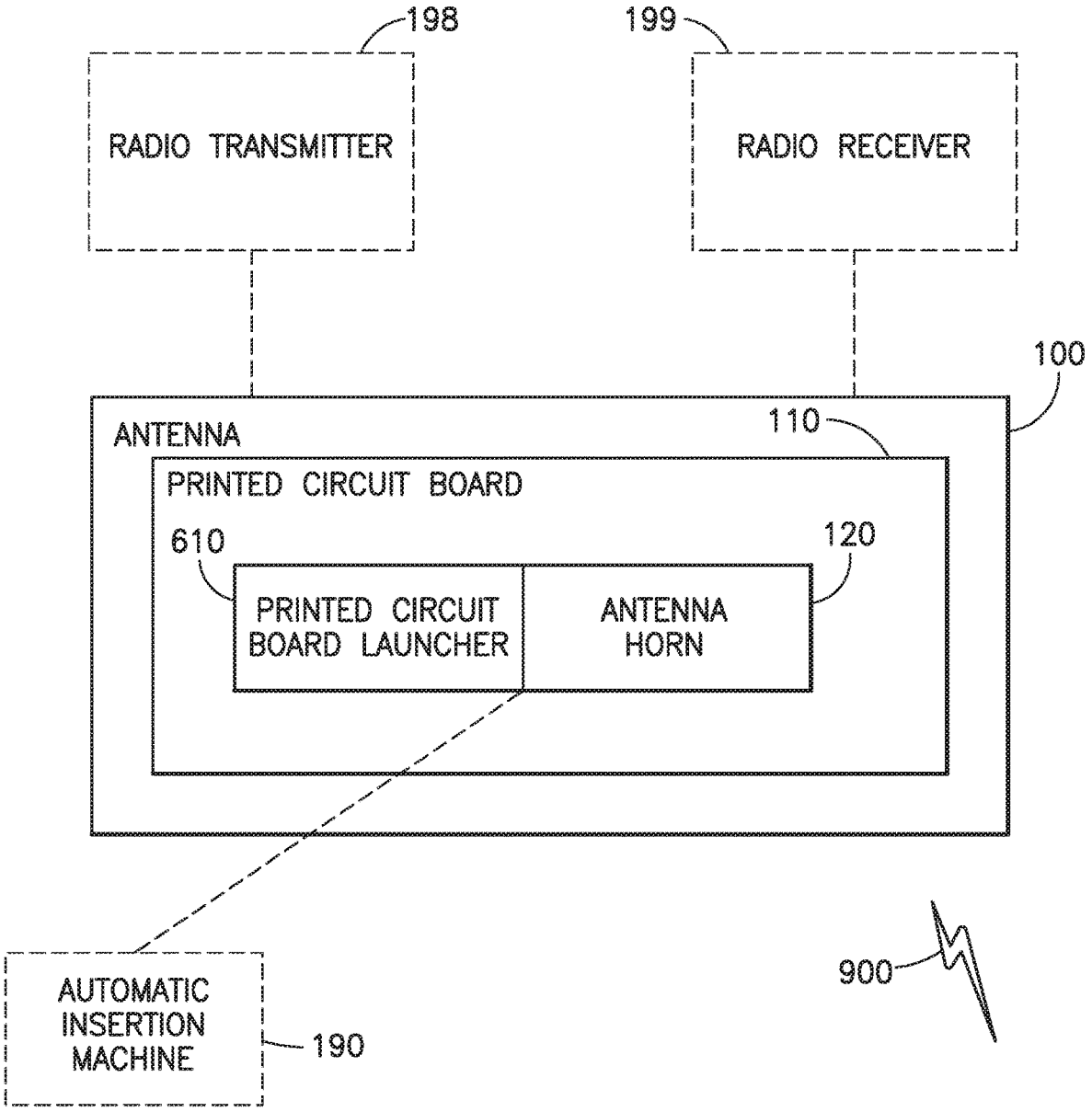
Figure 1B:
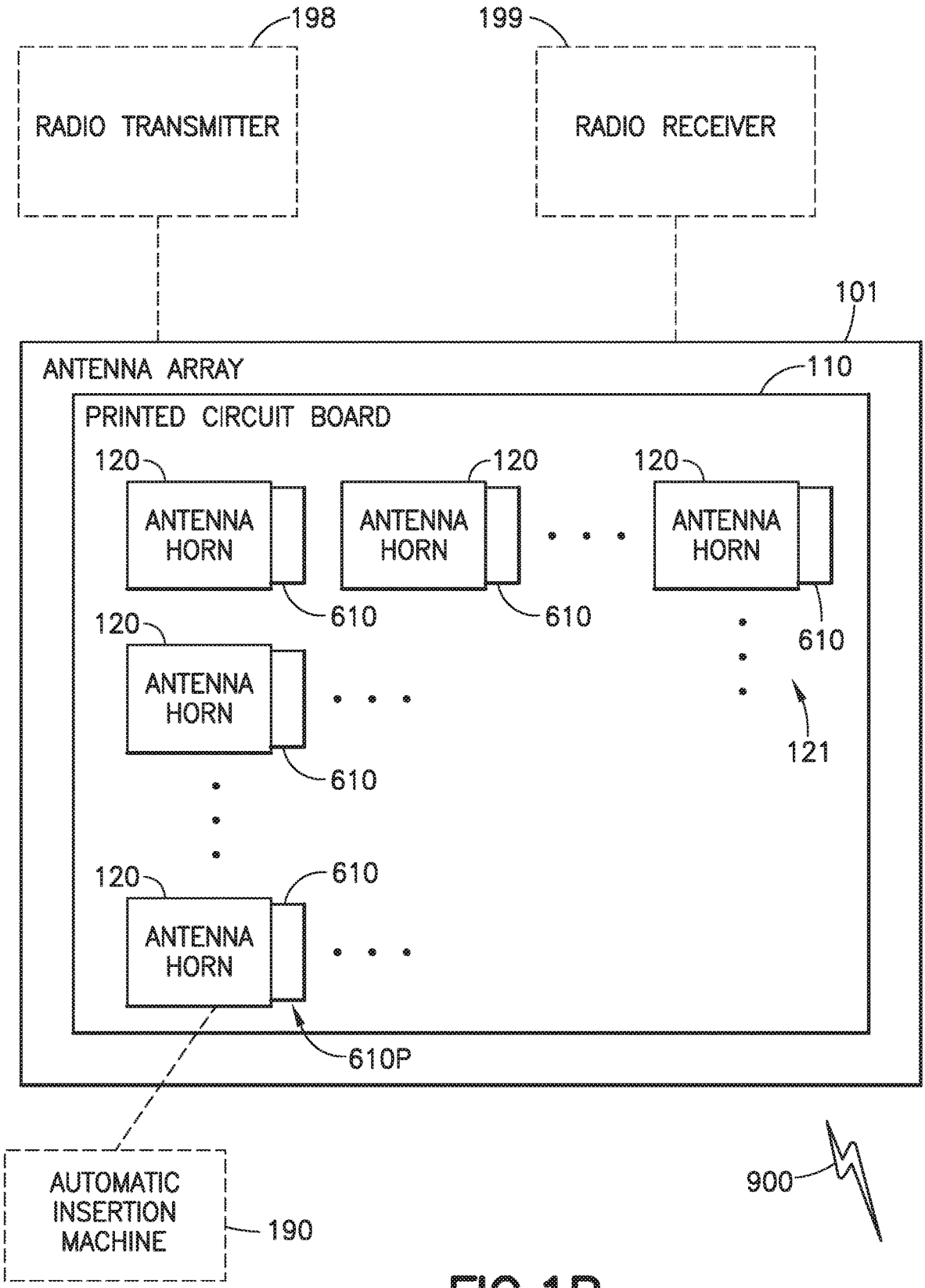
Figure 3A:
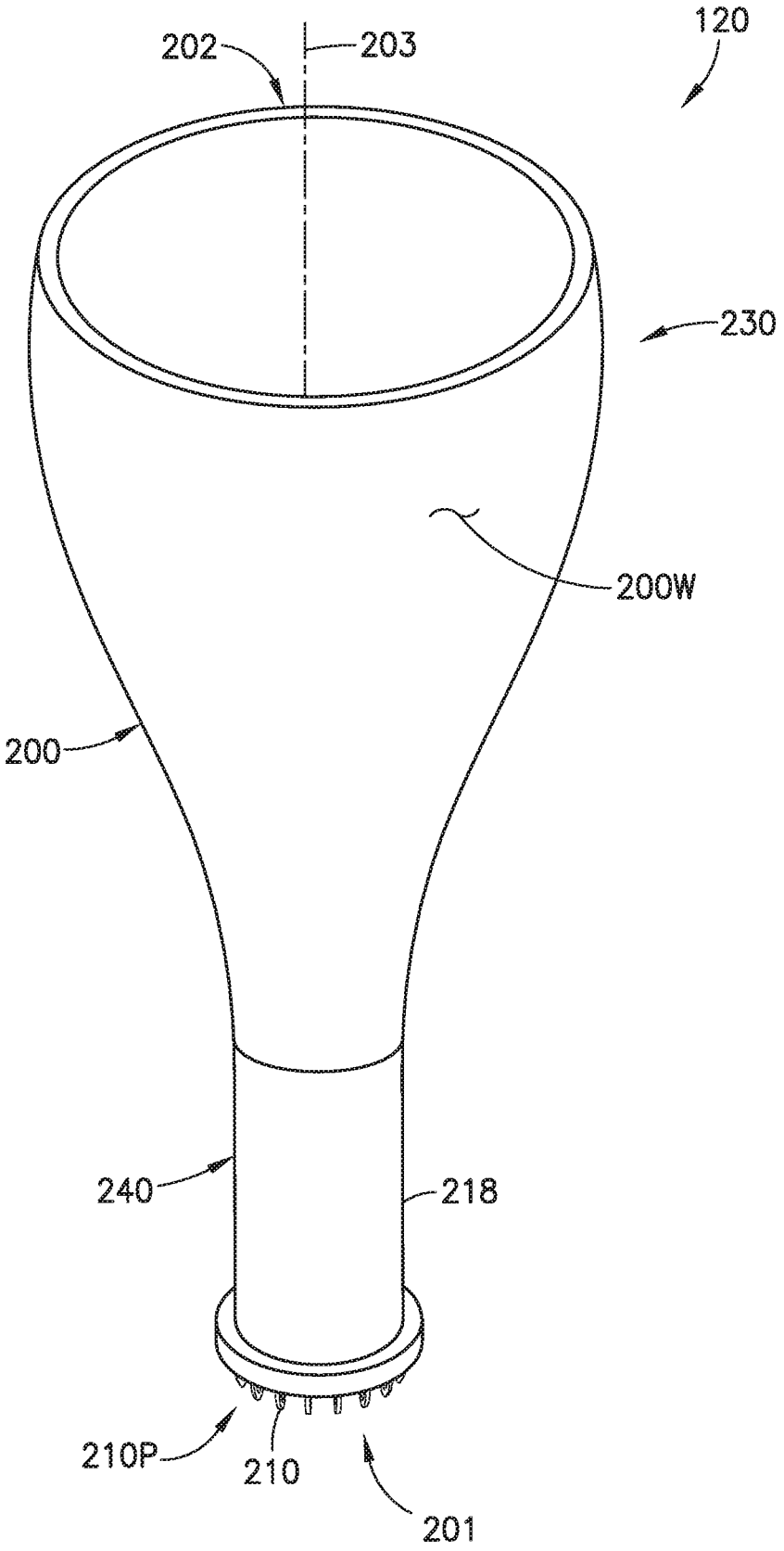
Figure 3C:
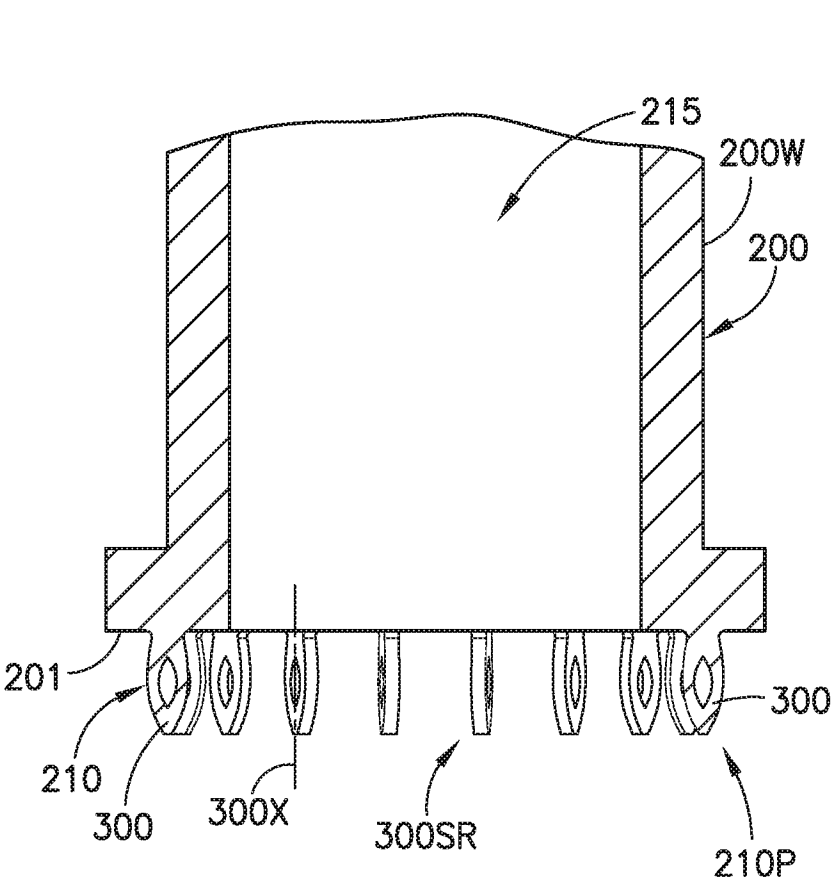
Figure 3B:
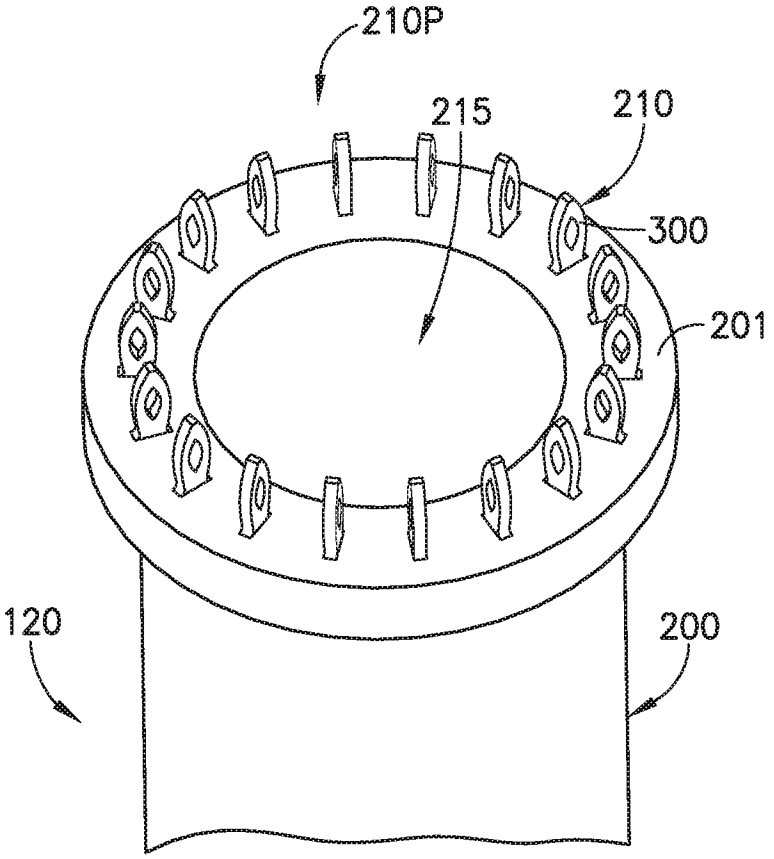
Figure 4A:
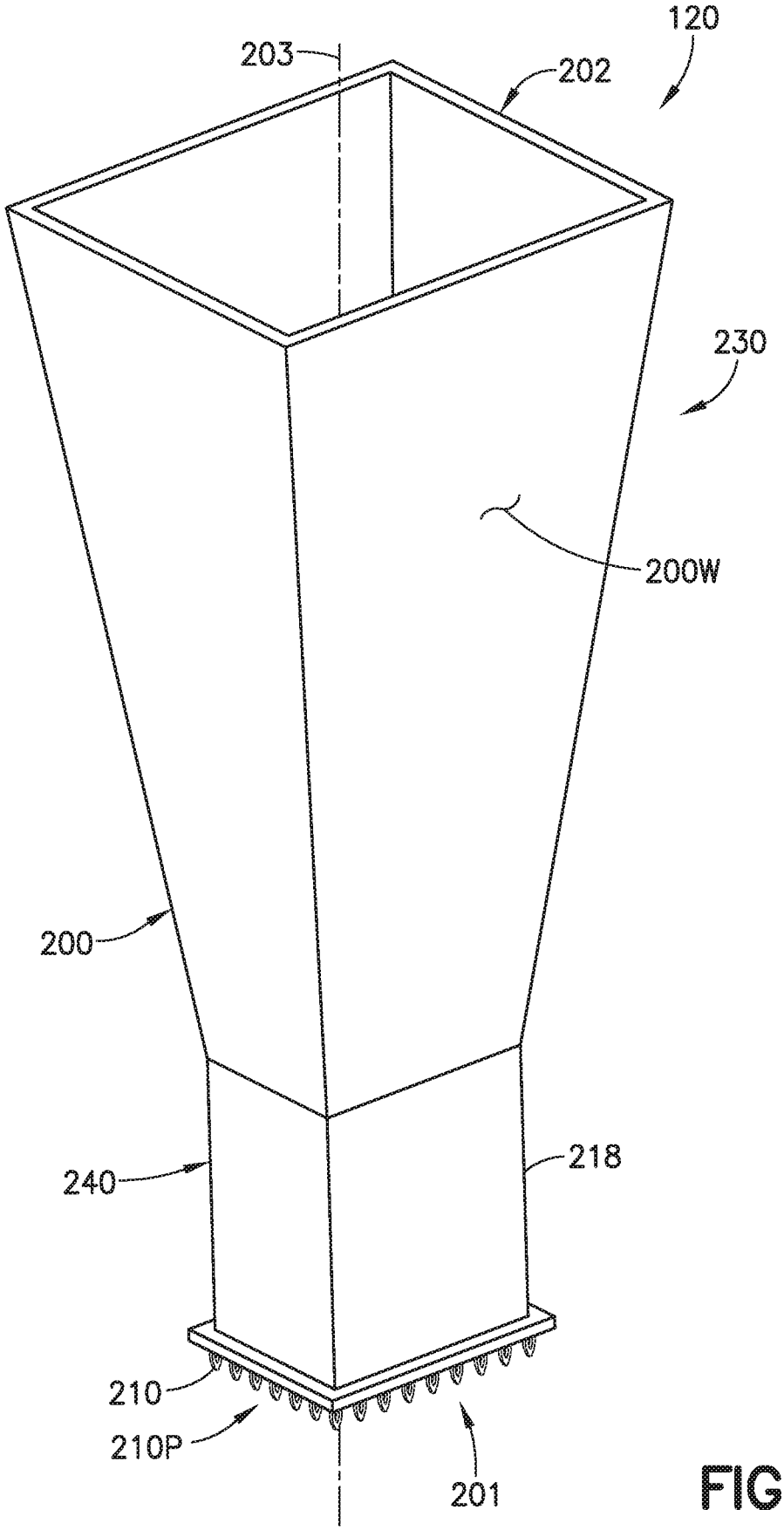
Figure 4C:
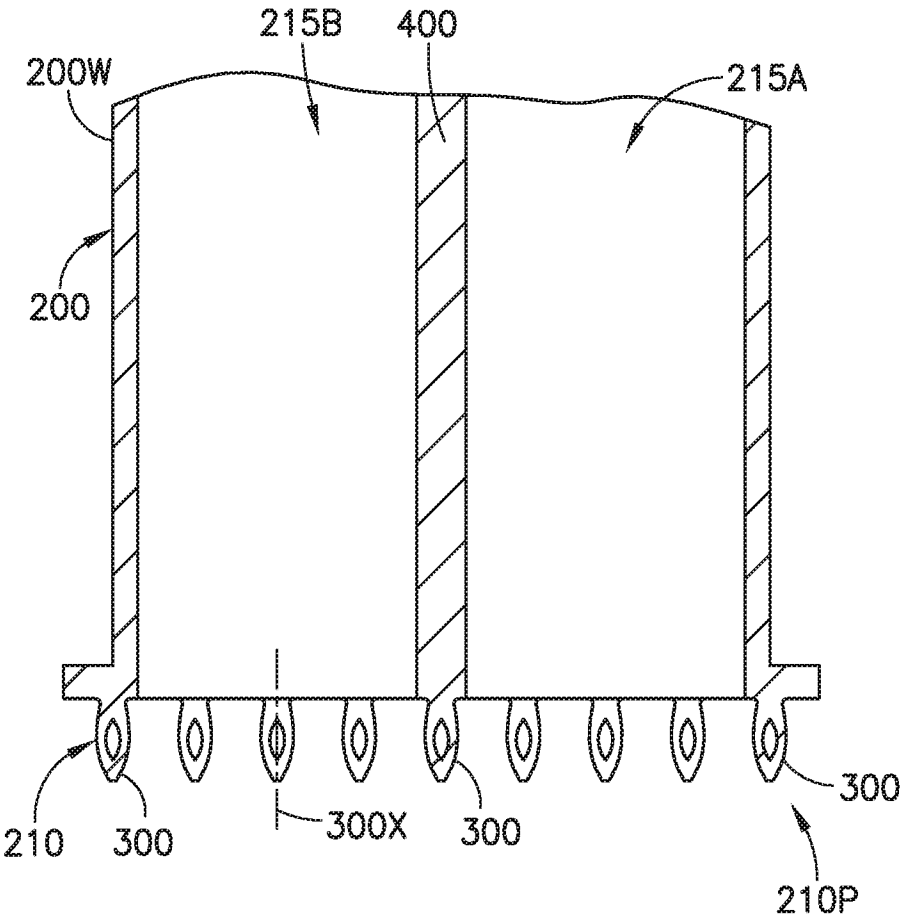
Figure 4B:
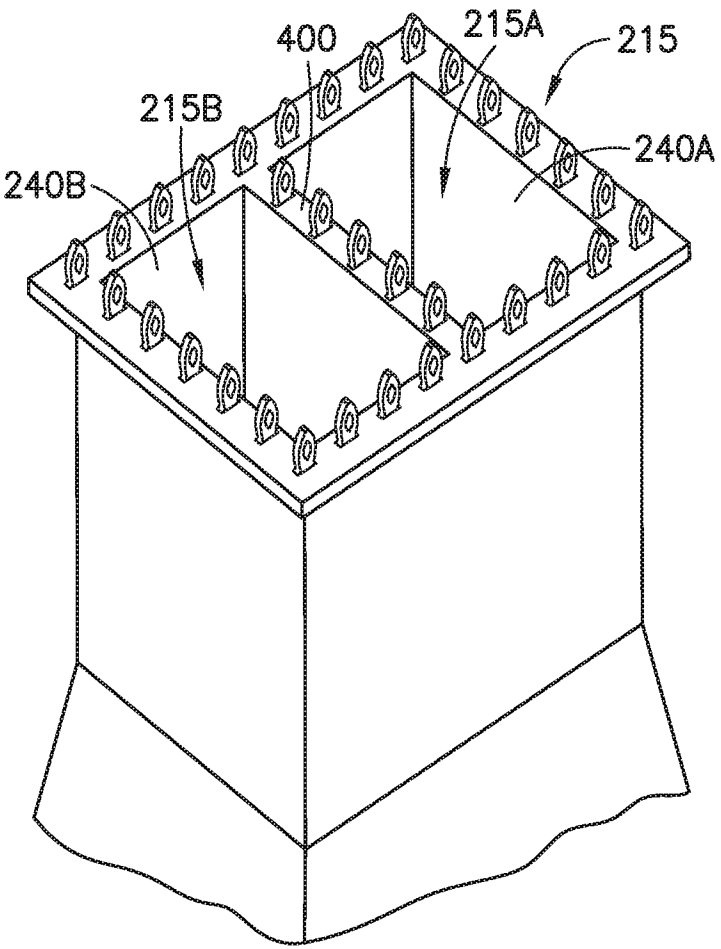
Figure 5:
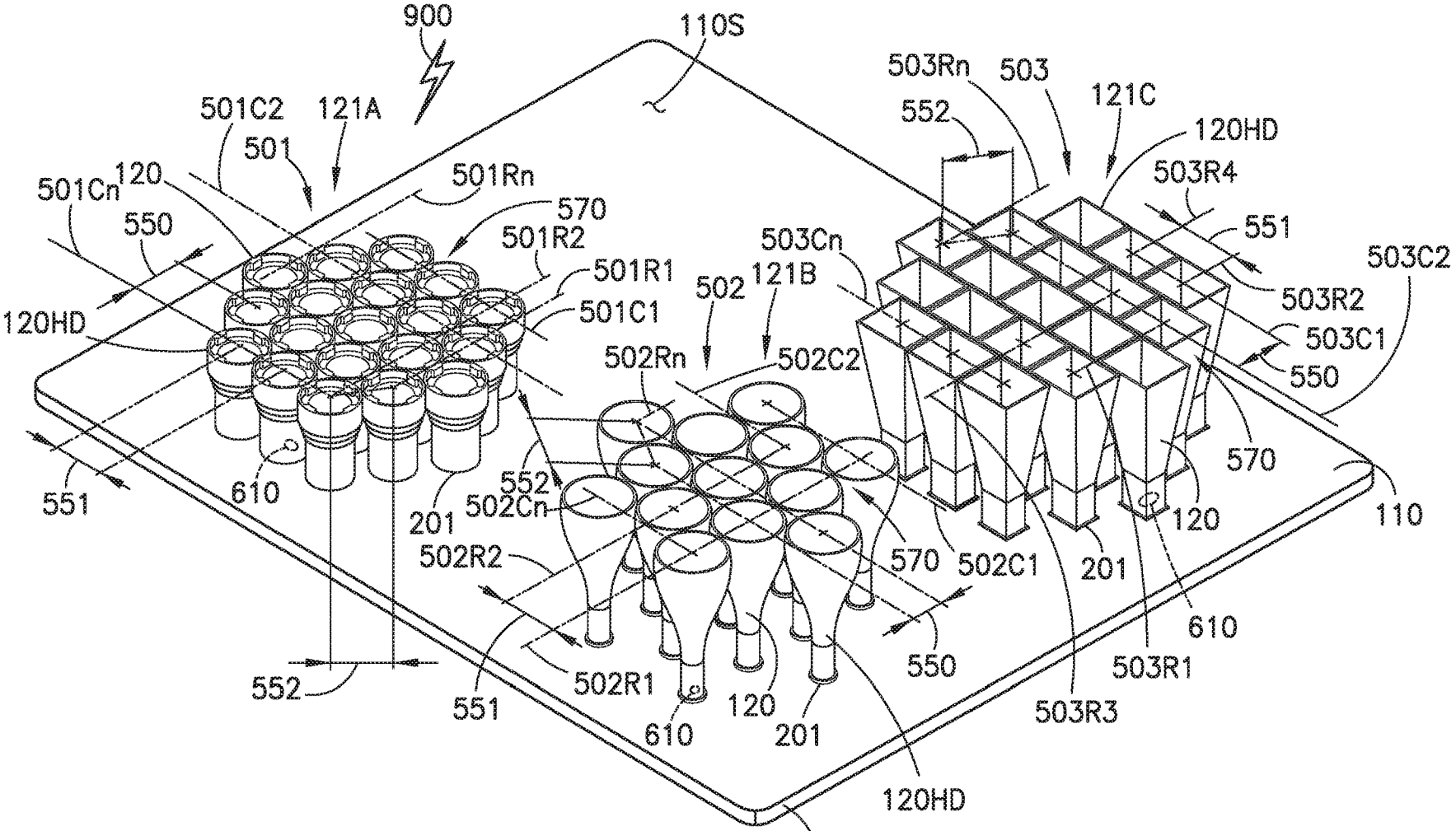
Figure 6A:
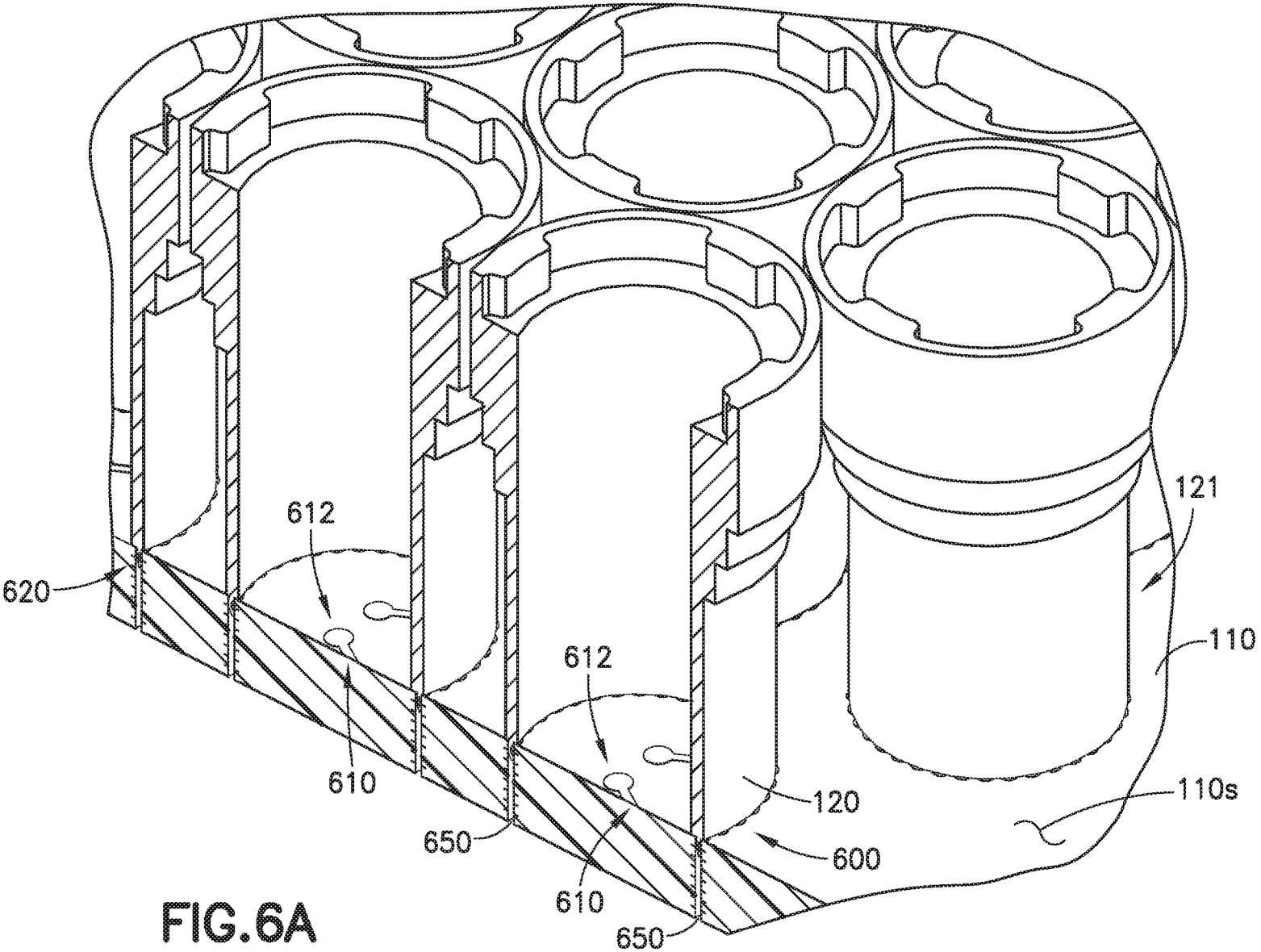
Figure 6B:
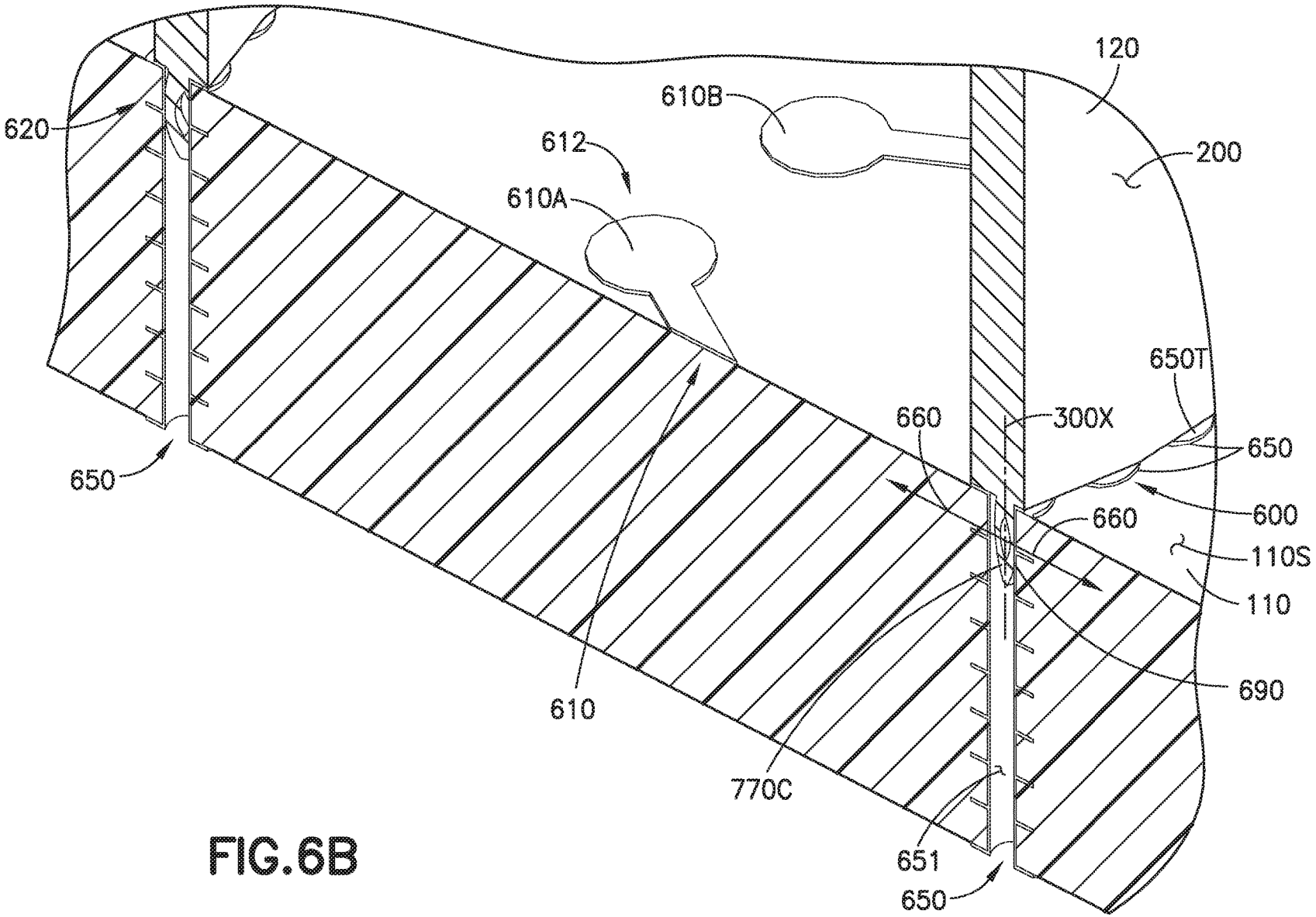
Figure 7:
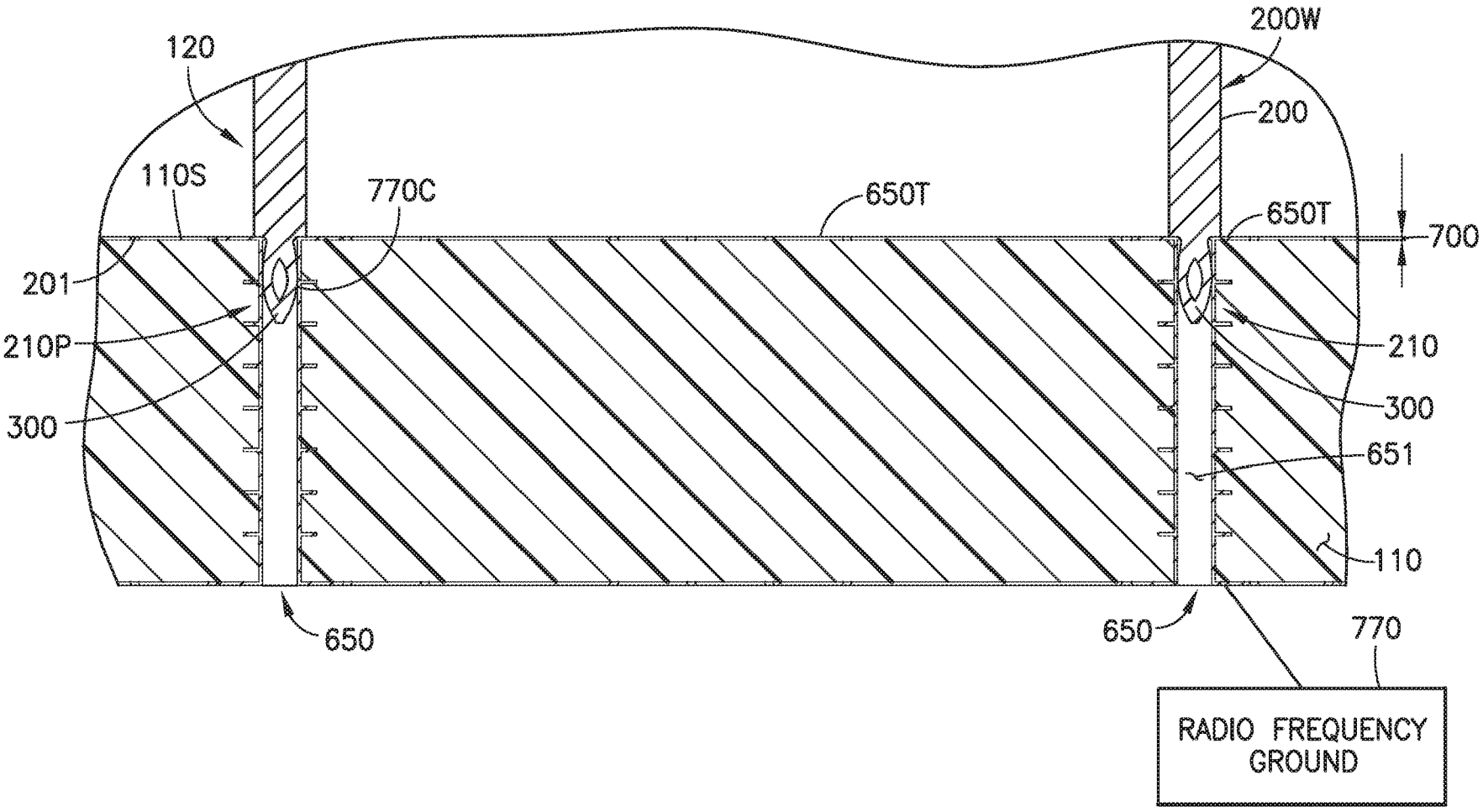
Figure 8:
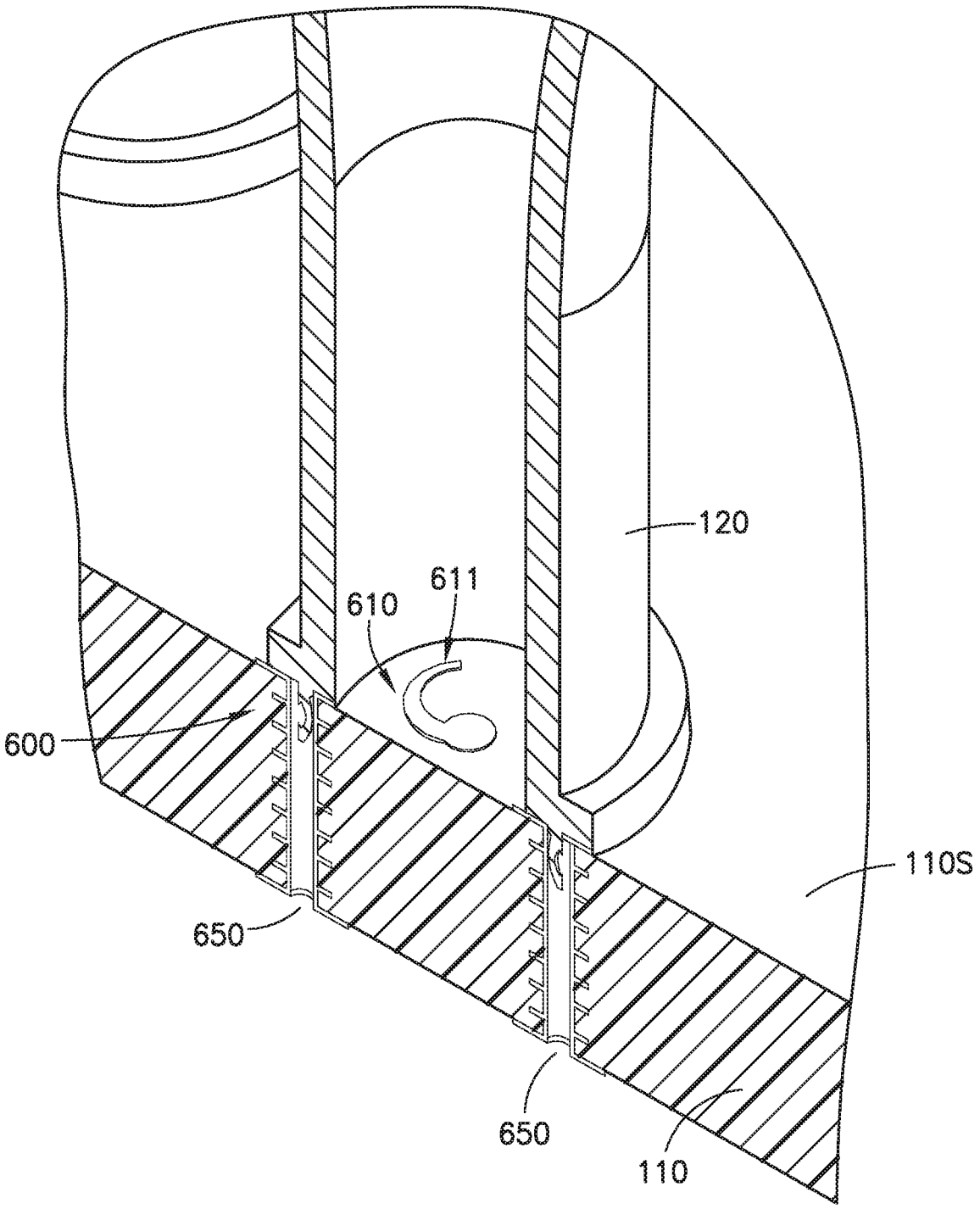
Figure 9A:
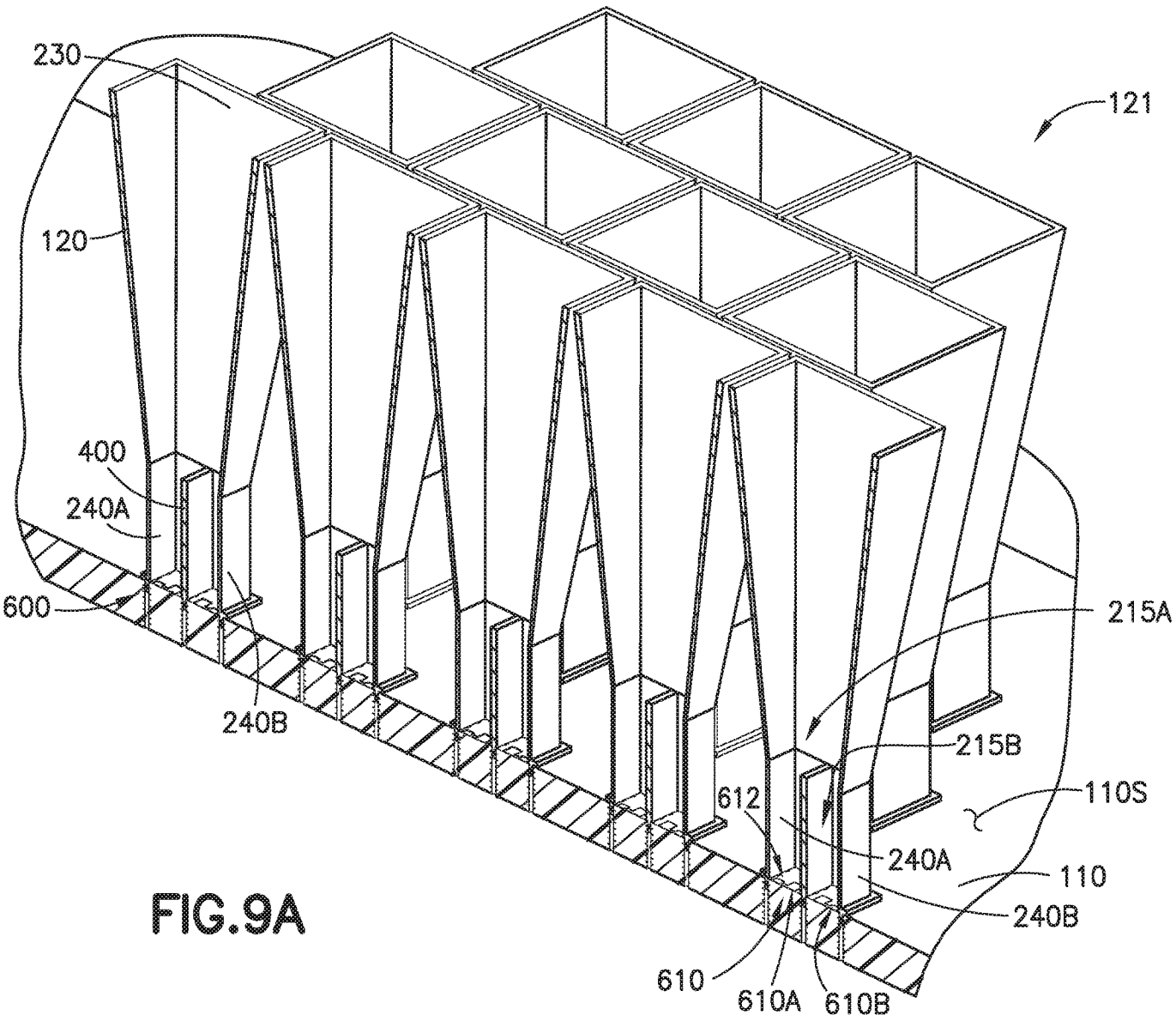
Figure 9B:
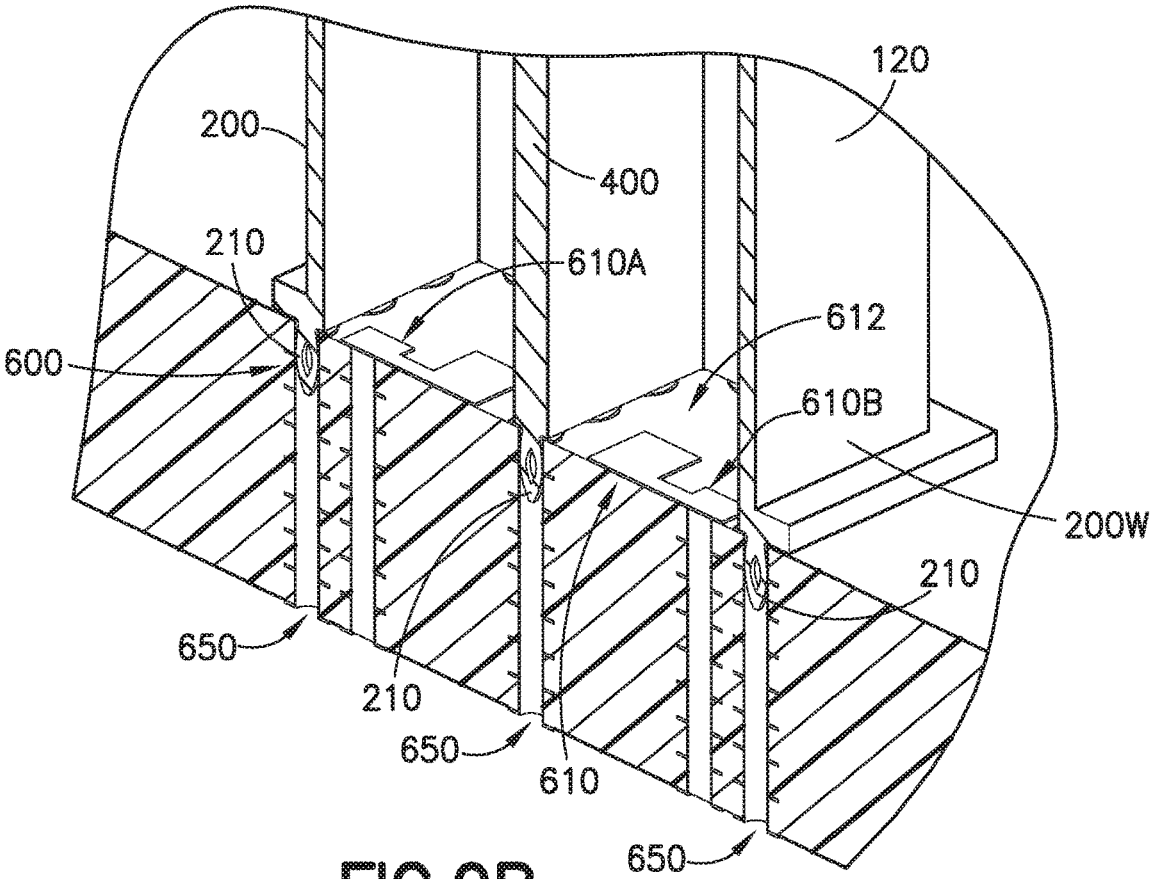
Figure 9C:
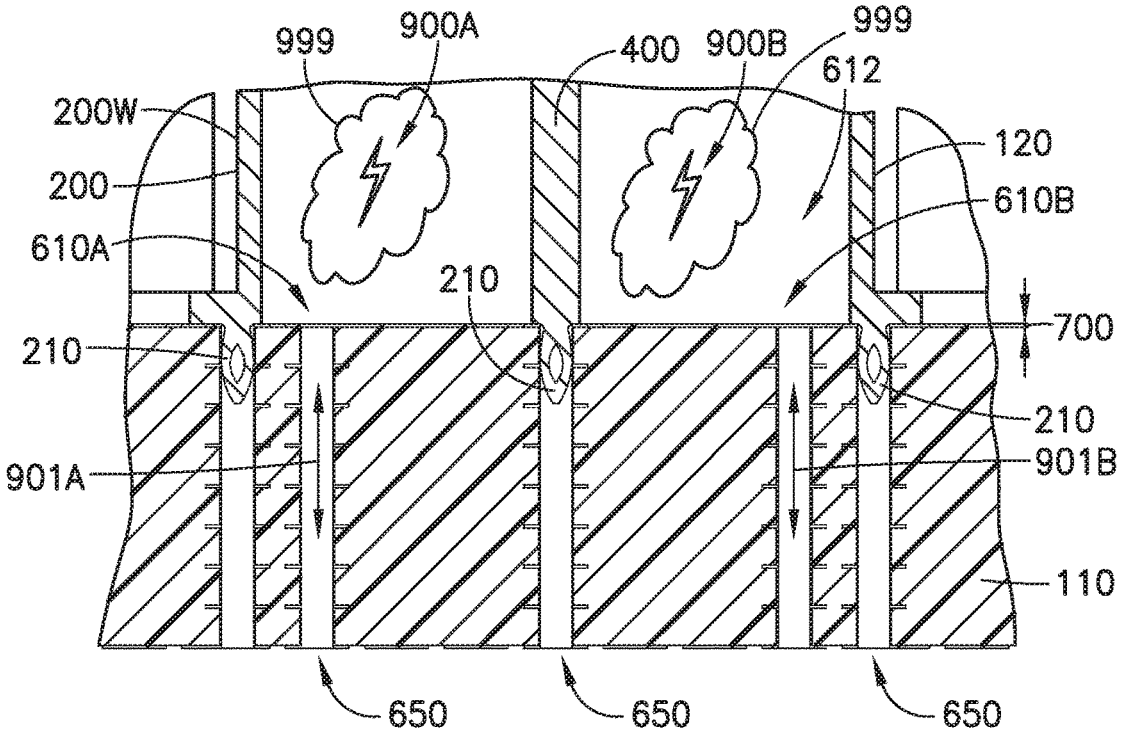
Figure 10:
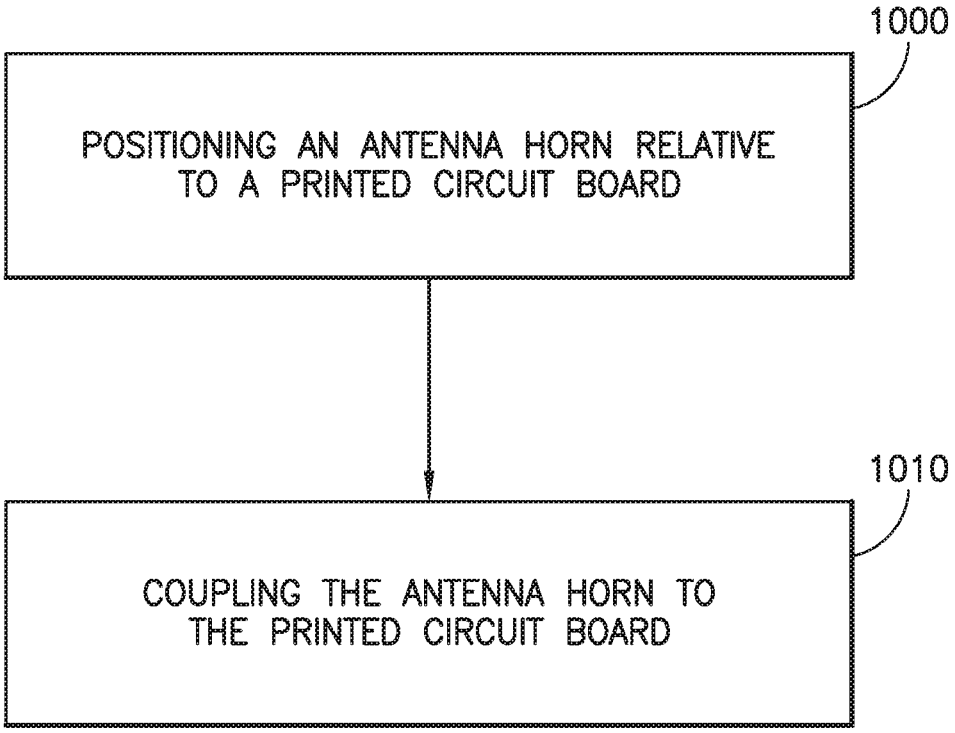

FIG. 5 is a perspective view of the antenna array of FIG. 1B showing exemplary arrays of the antenna horns of FIGS. 2A-4C in accordance with aspects of the present disclosure;

FIGS. 6A and 6B are partial perspective sectional views of a portion of the antenna array of FIG. 1B in accordance with aspects of the present disclosure;

FIG. 7 is a partial sectional side view of a portion of the antenna array of FIG. 1B in accordance with aspects of the present disclosure;

FIG. 8 is a partial perspective sectional view of a portion of the antenna array of FIG. 1B in accordance with aspects of the present disclosure;

FIGS. 9A and 9B are partial perspective sectional views of a portion of the antenna array of FIG. 1B in accordance with aspects of the present disclosure;

FIG. 9C is a partial sectional side view of a portion of the antenna array of FIGS. 9A and 9B in accordance with aspects of the present disclosure; and FIG. 10 is a flow diagram of an exemplary method in accordance with aspects of the present disclosure.

DETAILED DESCRIPTION

Illustrative, non-exhaustive examples, which may or may not be claimed, of the subject matter according to the present disclosure are provided below.

Referring to FIGS. 1A and 1B, the aspects of the present disclosure provide for an antenna horn 120, an antenna 100, and an antenna array 101 where the antenna horn 120 has a press fit configuration. For example, the antenna horn 120 is coupled to a radiating printed circuit board 110 (again, referred to herein as "printed circuit board") of the antenna 100 or the antenna array 101 by a press fit coupling 690 (FIG. 6B) without the use of special tools or an exotic clamping structure. The antenna horn 120 may be coupled to the printed circuit board 110 by hand or with an automatic insertion machine 190 that is configured to pick and place the antenna horn 120 to the printed circuit board 110. The press fit coupling 690 between the antenna horn 120 and the printed circuit board 110 substantially eliminates the use of solder, epoxy, screws and/or separate clamping structures to couple and hold the antenna horn 120 to the printed circuit board.

As there is no separate clamping structures or special tools for the coupling of the antenna horn 120 to the printed circuit board 110, the aspects of the present disclosure may also provide for positioning adjacent antenna horns 120 within an array of antenna horns 121 (FIG. 1B) relative to each other with any suitable center to center spacing (see FIG. 5) between the adjacent antenna horns 120. For example, the center to center spacing may be, but is not limited to, one or more of a sub-lambda (e.g., a spacing less than a wavelength of a radio frequency signal 900 (see FIG. 5) being transmitted and/or received by the antenna 100 or antenna array 101) spacing, a spacing equal to (or substantially equal to) the wavelength (i.e., lambda) being transmitted and/or received by the antenna 100 or antenna array 101, and a spacing greater than the wavelength (i.e., lambda) being transmitted and/or received by the antenna 100 or antenna array 101.

The press fit coupling 690 between the antenna horn 120 and the printed circuit board 110 also provides a radio frequency ground coupling 620 (see, e.g., FIGS. 6A and 6B) between the antenna horn 120 and the printed circuit board 110. The coupling between the antenna horn 120 and the printed circuit board 110 may also form a faraday cage 600 (see, e.g., FIGS. 6A and 6B) that isolates a radio frequency signal 900 (see, e.g., FIG. 5) to within a respective antenna horn 120 and to a respective printed circuit board launcher 610 (see, e.g., FIGS. 6A, 6B, 8, 9A, 9B, and 9C), where the printed circuit board launcher 610 is the point/portion of the printed circuit board 110 where the propagating wave 901A, 901B of the radio frequency signal 900, 900A, 900B (see, e.g., FIGS. 5 and 9C) changes transmission mediums, such as a change from propagating within the printed circuit board 110 to propagating within air/vacuum 999 (see FIG. 9C) and vice versa.

The aspects of the present disclosure may reduce the part count of the antenna 100 and antenna array 101, may reduce cost of the antenna 100 and antenna array 101, may reduce mass of the antenna 100 and antenna array 101, and may increase the density of the array of antenna horns 121 (FIG. 1B) of the antenna array 101.

Referring to FIG. 1A, the antenna 100 includes a printed circuit board 110 and an (e.g., one or more) antenna horn 120. The printed circuit board 110 has a (e.g., one or more) printed circuit board launcher 610 that corresponds with the antenna horn 120. The one or more antenna horns 120 are configured to couple with the printed circuit board 110 with a press fit coupling 690 (FIG. 6B) so that the antenna horn 120 circumscribes the printed circuit board launcher 610.

Referring to FIG. 1B the antenna array 101 includes a printed circuit board 110 and an array of antenna horns 121. In this aspect the printed circuit board 110 includes a plurality of printed circuit board launchers 610P positioned on the printed circuit board 110 in any suitable arrangement. The array of antenna horns 121 are configured to couple with the printed circuit board 110 so that each antenna horn 120 of the array of antenna horns 121 circumscribes a respective printed circuit board launcher 610. It is noted that regardless of whether the antenna includes one antenna horn 120 as in FIG. 1A or multiple antenna horns as in FIG. 1B, the coupling between the printed circuit board 110 and the antenna horn 120 as well as the features thereof are as described herein.

Referring to FIGS. 1A and 1B, one or more of a radio transmitter 198 and a radio receiver 199 may be coupled to the antenna 100 and/or antenna array 101 so as to generate and/or decode a radio frequency signal 900 where the radio frequency signal 900 is transmitted through and/or received by the antenna 100 and antenna array 101.

Figure 2A:
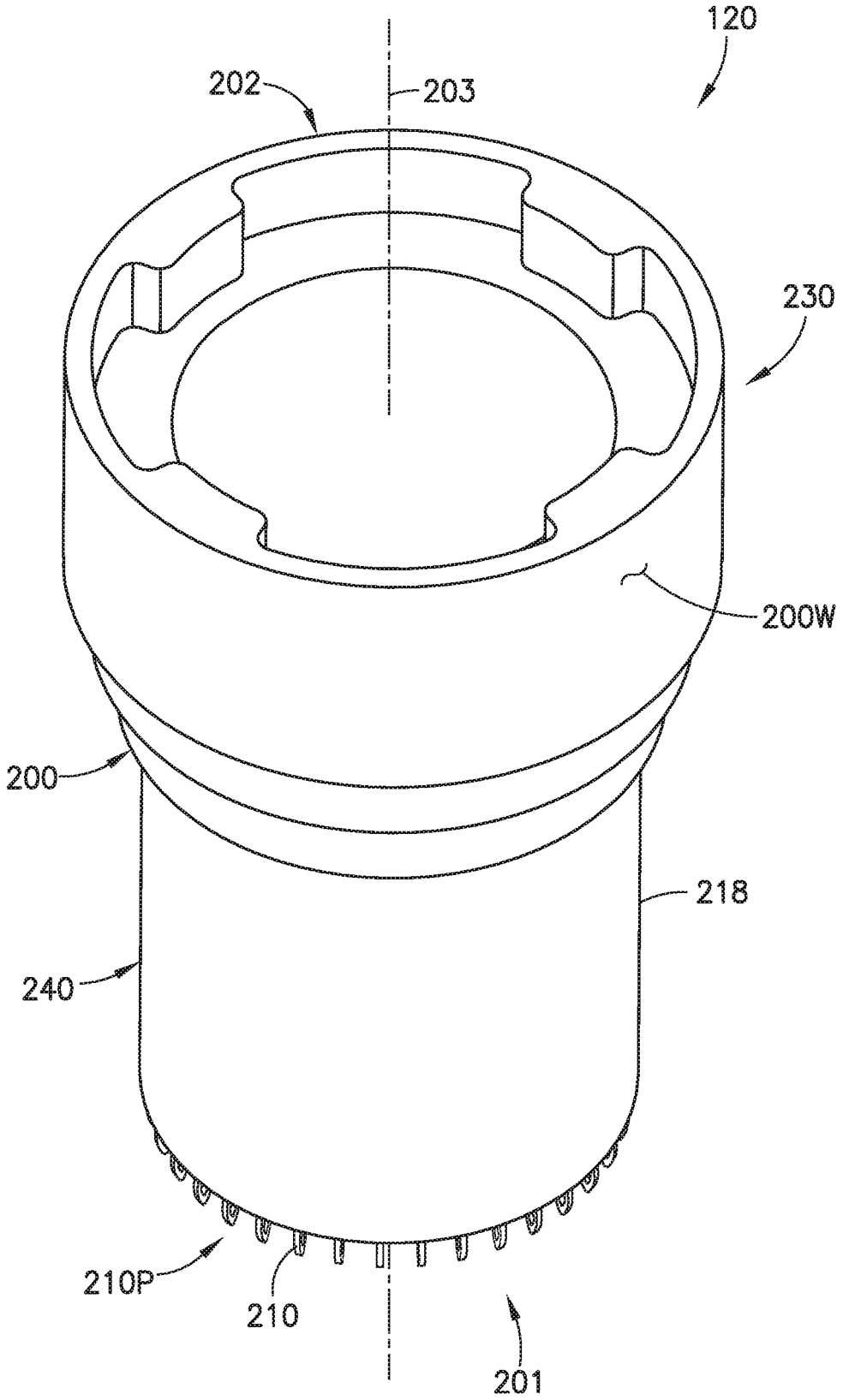
Figure 2B:
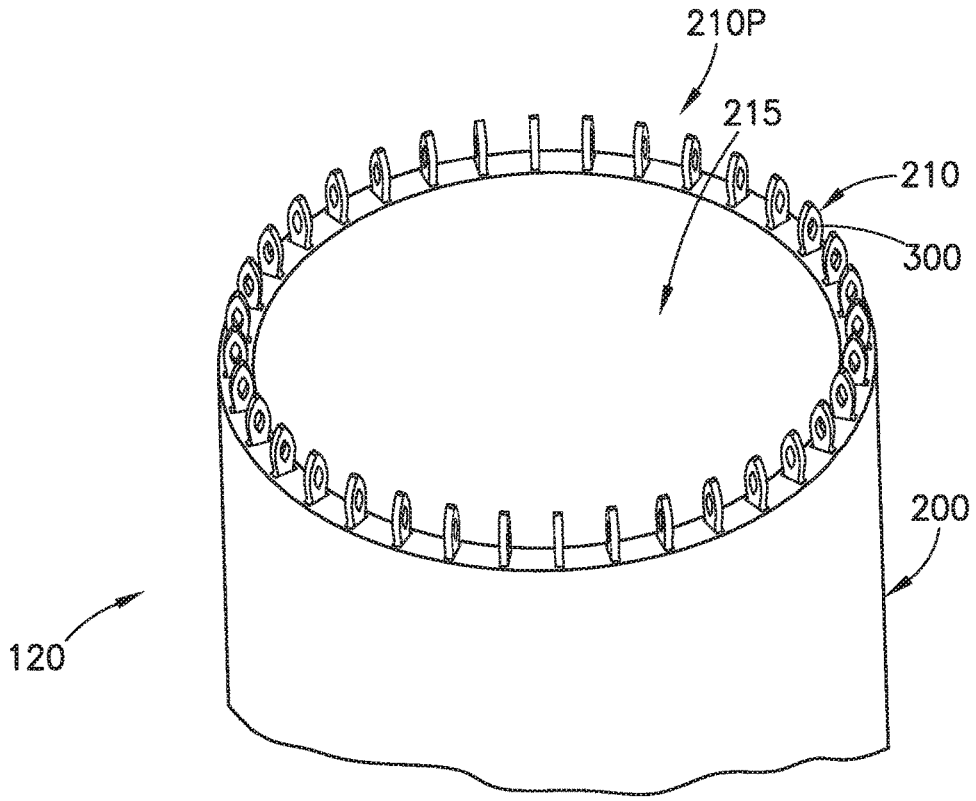

Referring also to FIGS. 2A, 3A, and 4A, the antenna horn 120 includes a frame 200 and a plurality of compliant coupling members 210P. Referring also to FIGS. 2B, 3B, 4B, the frame 120 has at least one aperture 215 forming a cup structure 218 that circumscribes a respective printed circuit board launcher 610 (see, e.g., FIGS. 5, 6A, 8, 9B which illustrate the cup structure circumscribing the respective printed circuit board launcher 610). The frame 200 having a first end 201 coupled to the printed circuit board 110 (see FIG. 5) and a second end 202 longitudinally spaced (relative to longitudinal axis 203 of the frame 200) from the first end 201 and extending from the printed circuit board 110 (see FIG. 5). The first end 201 and the second end 202 of the frame 200 (and the portion of the frame 200 between the first end 201 and the second end 202) may have any suitable cross sectional shape(s) such as, but not limited to, circular, rectangular, triangular, octagonal, and hexagonal cross sectional shapes and/or any suitable combinations thereof. For example, FIGS. 2A and 3A illustrate the frame 200 as having a substantially circular cross section while FIG. 4A illustrates the frame 200 as having a substantially rectangular cross section.

In one aspect, as shown in FIGS. 2A, 3A, 4A the frame 200 comprises a gain antenna horn element 230 formed by the at least one aperture 215. For exemplary purposes only, the gain antenna horn element 230 in FIG. 2A has a cup configuration; the gain antenna horn element 230 in FIG. 3A has a bell shaped configuration; and the gain antenna horn element 230 in FIG. 4A has a substantially pyramidal shaped configuration; however, the gain antenna horn element 230 may have any suitable shaped configuration. In another aspect, the frame 200 comprises a waveguide horn element 240 formed by the at least one aperture 215. The waveguide horn element 240 includes any suitable waveguide structure including, but not limited to, one or more of a filter, a polarizer, and a coupler. While the figures illustrate the frame 200 as having both the gain antenna horn element 230 and the waveguide horn element 240, in other aspects the frame 200 may include only the gain antenna horn element 230 or only the waveguide horn element 240. Referring to FIG. 4B, the at least one aperture 215 comprises at least two apertures 215A, 215B that form respective waveguide horn elements 240A, 240B arranged adjacent one another, where the frame 200 forms the gain antenna horn element 230 that is common to the at least two waveguide horn elements 240A, 240B (see FIG. 9A).

Figure 2C:
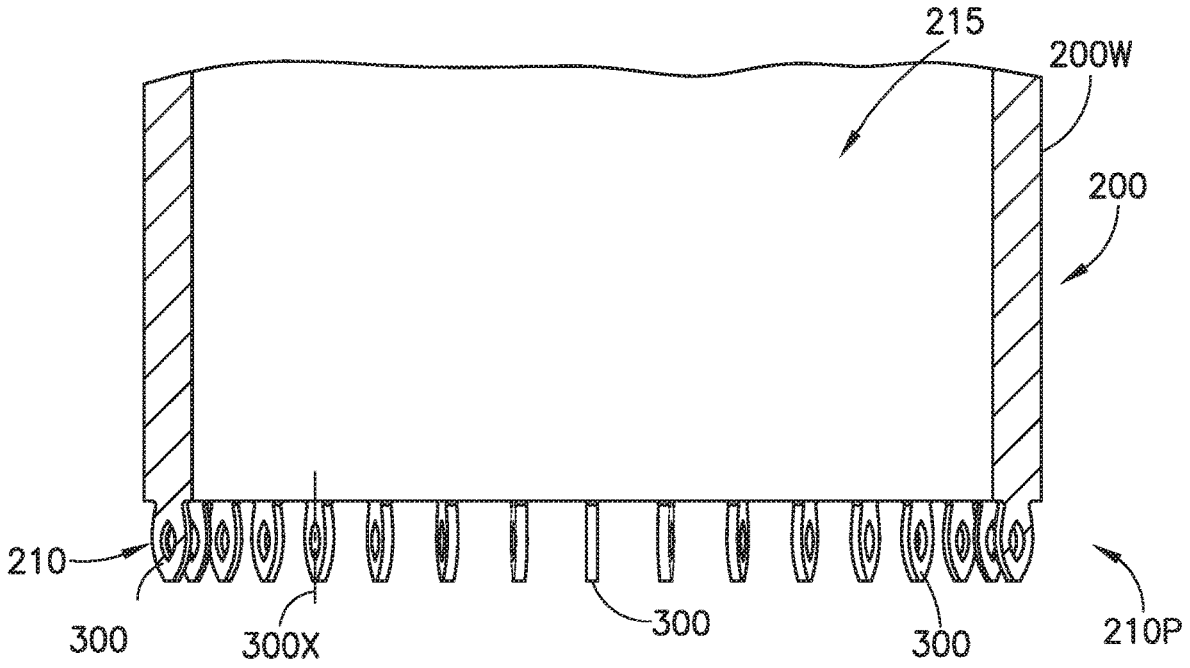

Referring to FIGS. 2A, 2B, 3A, 3B, 4A, and 4B, the plurality of compliant coupling members 210P extend longitudinally from the first end 201. Each of the plurality of compliant coupling members 210 is configured to couple with respective receiving apertures 650 (see, e.g., FIG. 6B) of the printed circuit board 110 such that coupling of plurality of compliant coupling members 210P and the respective receiving apertures 650 solely (e.g., without any additional coupling structure such as screws, solder, epoxy, clamps, etc.) couples the antenna horn 120 to the printed circuit board 110. For example, each of the plurality of compliant coupling members 210P is configured so as to be press fit into a respective receiving aperture 650 of the printed circuit board 110, where each compliant coupling member 210 is compliant so as to elastically deform within the respective receiving aperture 650. Referring also to FIGS. 2C, 3C, and 4C, the plurality of compliant coupling members 210P comprise compliant pins 300 configured to exert an outward retention force 660 (e.g., in one or more directions that are outwards relative to or otherwise transverse to a longitudinal axis 300X of the respective compliant pin 300) against a wall 651 (see, e.g., FIG. 6B) of the respective receiving apertures 650 such that coupling of plurality of compliant coupling members 210P and the respective receiving apertures 650 solely couples the respective antenna horn 120 to the printed circuit board 110. In one aspect, the compliant pins 300 have a surface roughness 300SR (see FIG. 3C) configured to grip the wall 651 of the respective receiving aperture 650 such that coupling of plurality of compliant coupling members 210P and the respective receiving apertures 650 solely couples the respective antenna horn 120 to the printed circuit board 110. The plurality of compliant coupling members 210P are integrally formed with the frame 200, while in other aspects the plurality of compliant coupling members 210P may be coupled to the frame 200 in any suitable manner.

Referring to FIGS. 2B, 3B, 4B, 6A, 6B, 8, 9A, and 9B, the plurality of compliant coupling members 210P circumscribe the at least one aperture 215 so as to, when the respective antenna horn 120 is coupled to the printed circuit board 110, form the faraday cage 600. The faraday cage 600 extends, for example, from the first end 201 of the respective antenna horn 120 to a surface 110S (see FIGS. 6A-9A) of the printed circuit board 110 on which the respective antenna horn 120 is disposed. Referring also to FIGS. 6B and 7, the first end 201 of the antenna horn 120 may rest on one or more electrically conductive traces 650T of the receiving apertures 650. The one or more electrically conductive traces 650T may protrude above the surface 110S of the printed circuit board 110 so that a gap 700 exists between the first end 201 of the antenna horn 120 and the surface 110S of the printed circuit board 110. The gap 700 may be about 0.1 mm (about 0.004 inches) or less. The faraday cage 600 extends between the first end 201 of the antenna horn 120 into the receiving apertures 650, bridging the gap 700 to substantially prevent radio frequency signal 900 leakage from between the frame 200 and the printed circuit board 110. The faraday cage 600 may also substantially isolate the radio frequency signals 900 to within a respective aperture of the at least one aperture 215. As shown in FIGS. 4B and 9B, where the frame 200 includes the at least two waveguide horn elements 240A, 240B, the plurality of compliant coupling members 210P are disposed between adjacent waveguide horn elements 240A, 240B (e.g., such as on a partition wall 400 of the frame 200) and, when the respective antenna horn 120 is coupled to the respective receiving apertures 650 of the printed circuit board 110, substantially provide (e.g., through the faraday cage 600) radio frequency signal 900 isolation between the adjacent waveguide horn elements 240A, 240B.

Still referring to FIGS. 2B, 3B, 4B, 6A, 6B, 8, 9A, and 9B, when the antenna horn 120 is coupled to the printed circuit board 110, the plurality of compliant coupling members 210P circumscribe the respective printed circuit board launcher 610 so that the faraday cage 600 substantially isolates radio frequency signals 900 to within the (respective) antenna horn 120. The printed circuit board launcher(s) 610 of the printed circuit board 110 are one of both a single polarization launcher 611 (see FIG. 8) and a dual polarization launcher 612 (see FIGS. 6A, 6B, 9A, 9B, 9C). The dual polarization launcher 612 includes printed circuit board launcher elements, such as a first and second polarization elements 610A, 610B, each of which have a different polarization (e.g., left hand polarization, right hand polarization or any suitable polarizations).

As noted above, the faraday cage 600 spans (e.g., extends through) the gap 700 between the first end 201 and the surface 110S of the printed circuit board 110 so that the plurality of compliant coupling members 210P circumscribe the respective printed circuit board launcher 610 to substantially prevent (e.g., through the faraday cage 600) radio frequency signal 900 leakage from between the frame 200 and the printed circuit board 110. The plurality of compliant coupling members 210P circumscribe the respective printed circuit board launcher 610 so as to substantially prevent (e.g., through the faraday cage 600) radio frequency signal 900 interference between adjacent antenna horns 120 and between adjacent waveguide horn elements 240A, 240B of a common antenna horn 120. For example, as shown in FIGS. 4B and 9B, where the frame 200 includes the at least two waveguide horn elements 240A, 240B, the at least one aperture 215 (see, e.g., FIG. 4B) comprises two apertures 215A, 215B, a first of the two apertures 215A forms a first waveguide horn element 240A (see, e.g., FIGS. 4B and 9A) for a first polarization element 610A of the dual polarization launcher 612 and a second of the two apertures 215B forms a second waveguide horn element 240B (see, e.g., FIGS. 4B and 9A) for a second polarization element 610B of the dual polarization launcher 612. One or more of the plurality of compliant coupling members 210P are disposed between the first waveguide horn element 240A and the second waveguide horn element 240B to isolate the first polarization element 610A and the second polarization element 610B. For example, the plurality of compliant coupling members 210P are disposed between adjacent waveguide horn elements 240A, 240B (e.g., such as on a partition wall 400 of the frame 200) and, when the respective antenna horn 120 is coupled to the respective receiving apertures 650 of the printed circuit board 110, circumscribe the respective first and second polarization elements 610A, 610B to substantially provide (e.g., through faraday cages 600 formed around a perimeter of each of the waveguide horn elements 240A, 240B) radio frequency signal 900 isolation between the adjacent waveguide horn elements 240A, 240B.

Referring to FIGS. 6B and 7, the printed circuit board 110 is configured so that the one or more electrically conductive traces 650T of the receiving apertures 650 are coupled to each other to form a radio frequency ground 770. The one or more electrically conductive traces 650T extend through the receiving aperture and form the wall 651 of the respective receiving apertures 650. The plurality of compliant coupling members 210P are configured to form a radio frequency ground coupling 770C between the frame 200 and the printed circuit board 110. The radio frequency ground coupling 770C between the frame 200 and the printed circuit board 110 is effected through the compliancy of the compliant coupling members 210P and the press fit coupling 690 between the compliant coupling members 210P and the walls 651 of the receiving apertures 650. For example, upon insertion of a compliant coupling member 210 into a receiving aperture 650 the compliant coupling member 210 resiliently deforms under the influence of the wall 651 of the respective receiving aperture 650 so that the compliant coupling member 210 exerts the outward retention force 660 against the wall 651, where the resulting contact between the compliant coupling member 210 and the wall 651 (e.g., formed by the one or more electrically conductive traces 650T) forms a conductive coupling (i.e., the radio frequency ground coupling 770C) between compliant coupling member 210 and the one or more electrically conductive traces 650T (i.e., between the frame 200 and the printed circuit board 110).

Referring to FIG. 5, an antenna array 101 is illustrated having exemplary groupings 501, 502, 503 of the antenna horns 120. Grouping 501 includes an array of antenna horns 121A including the antenna horn 120 of FIGS. 2A-2C. The antenna horns 120 of the array of antenna horns 121A are arranged in any suitable number of rows 501R1-501Rn and any suitable number of columns 501C1-501Cn. One or more of the rows 501R1-501Rn and columns 501C1-501Cn may be staggered so as to form a honeycomb pattern of antenna horns. Grouping 502 includes an array of antenna horns 121B including the antenna horn 120 of FIGS. 3A-3C. The antenna horns 120 of the array of antenna horns 121B are arranged in any suitable number of rows 502R1-502Rn and any suitable number of columns 502C1-502Cn. One or more of the rows 502R1-502Rn and columns 502C1-502Cn may be staggered so as to form a honeycomb pattern of antenna horns. Grouping 503 includes an array of antenna horns 121C including the antenna horn 120 of FIGS. 4A-4C. The antenna horns 120 of the array of antenna horns 121C are arranged in any suitable number of rows 503R1-503Rn and any suitable number of columns 503C1-503Cn. One or more of the rows 503R1-503Rn and columns 503C1-503Cn may be staggered so as to form a brick wall pattern of antenna horns. While antenna horns 120 of the arrays of antenna horns 121A, 121B, 121C are shown as being coupled to a common printed circuit board 110, in other aspects the printed circuit board may include an array of antenna horns where the antenna horns have a common configuration. For example, the printed circuit board 110 may have coupled thereto an array of antenna horns that only includes the antenna horn 120 illustrated in FIGS. 2A-2C; the printed circuit board 110 may have coupled thereto an array of antenna horns that only includes the antenna horn 120 illustrated in FIGS. 3A-3C; or the printed circuit board 110 may have coupled thereto an array of antenna horns that only includes the antenna horn 120 illustrated in FIGS. 3A-3C. In other aspects, the printed circuit board 110 may have coupled thereto any suitable number of groupings of antenna horns 120, where the antenna horns 120 have any suitable configuration.

In one aspect, spacing between the rows 501R1-501Rn, 502R1-502Rn, 503R1-503Rn and spacing between the columns 501C1-501Cn, 502C1-502Cn, 503C1-503Cn are established based on the locations of the printed circuit board launchers 610 of the printed circuit board 110 so that each antenna horn 120 of the array of antenna horns 121A, 121B, 121C circumscribes the respective printed circuit board launcher 610 as described above. In another aspect, spacing between the rows 501R1-501Rn, 502R1-502Rn, 503R1-503Rn and spacing between the columns 501C1-501Cn, 502C1-502Cn, 503C1-503Cn (as well as the locations of the printed circuit board launchers 610 of the printed circuit board 110) are established based on the dimensions of the second ends 202 of the antenna horns 120 such that a spacing (i.e., distance) between second ends 202 of adjacent antenna horns 120 prevents access (such as for tools, clamps, etc.) to the first ends 201 of the adjacent antenna horns 120 at the printed circuit board 110 (e.g., access to the first ends 201 and printed circuit board 110 is prevented such that the press fit coupling between each antenna horn 120 and the printed circuit board 110 is the only coupling/structure holding the antenna horns 120 to the printed circuit board 110). For example, referring also to FIGS. 2A, 3A, and 4A, the spacing 570 between the outer walls 200W of the frame 200 at or adjacent the second ends 202 of the adjacent antenna horns 120 may be such that the outer walls 200W of adjacent antenna horns 120 are substantially in contact with each other or the spacing 570 is de minimis, that is, so small to be of little importance, such as about 0.1 mm (about 0.004 inches) or less. In other aspects the spacing 570 may be any suitable spacing.

The antenna horns 120 of the array of antenna horns 121A, 121B, 121C are configured as a high density phase array antenna horn 120HD where a center to center spacing (e.g., distance) between adjacent antenna horns 120, from center to center, on the printed circuit board is a sub-lambda spacing (e.g., a spacing that is less than the wavelength of the radio frequency signal passing through the antenna horn). In one aspect, the sub-lambda spacing is less than about half a wavelength of the radio frequency signal passing through the antenna horn 120 while in other aspects the center to center spacing between adjacent antenna horns 120 may be any suitable spacing. The center to center spacing is one or more of the spacing 550 between the columns 501C1-501Cn, 502C1-502Cn, 503C1-503Cn, the spacing 551 between the rows 501R1-501Rn, 502R1-502Rn, 503R1-503Rn, and the spacing 552 between the centers of adjacent but staggered/offset antenna horns 120. The center to center spacing between the adjacent antenna horns 120 is effected by the press fit coupling 690 (FIG. 6B) between the antenna horns 120 and the printed circuit board 110, as the use of, e.g., bulky exotic clamping structure and screws, solder, etc. for holding the antenna horns 120 to the printed circuit board 110 may be avoided.

Referring to FIGS. 1A, 6A, 6B, 8, 9A, and 10 an exemplary method for forming the antenna 100 will be described. The method includes positioning an antenna horn 120 relative to a printed circuit board 110 (FIG. 10, Block 1000) so that the antenna horn 120 circumscribes a printed circuit board launcher 610 of the printed circuit board 110. The antenna horn 120 is coupled to the printed circuit board 110 (FIG. 10, Block 1010) solely by coupling the plurality of compliant coupling members 210P, extending from the frame 200 of the antenna horn 120, and the respective receiving apertures 650 of the printed circuit board 110. Coupling the plurality of compliant coupling members 210P and respective receiving apertures 650 of the printed circuit board 110 includes press-fitting the plurality of compliant coupling members 210P into the respective receiving apertures 650. In one aspect, the antenna horns 120 are configured for automated press-fit coupling with the printed circuit board 110. For example, the antenna horns 120 may be configured in any suitable manner so as to be gripped by a gripper of an automatic insertion machine 190, where the automatic insertion machine 190 positions the antenna horn 120 relative to printed circuit board 110 and couples (e.g., by press fitting) the antenna horn 120 with the printed circuit board 110. In other aspects, the antenna hors may be press fit to the printed circuit board in any suitable manner, such as manually. Coupling the antenna horn to the printed circuit board may also form the faraday cage 600, where the plurality of compliant coupling members 210P of the antenna horn 120 circumscribe the printed circuit board launcher 610, so that the faraday cage 600 substantially isolates radio frequency signals 900 to within the antenna horn 120. Radio frequency signal leakage may also be prevented from between the antenna horn 120 and the printed circuit board 110 with, e.g., the faraday cage 600 formed by the plurality of compliant coupling members 210P of the antenna horn 120 circumscribing the printed circuit board launcher 610.

Referring to FIGS. 1B, 5, 6A, 6B, 8, 9A, and 10 an exemplary method for forming the antenna array 101 will be described. The method includes positioning an antenna horn 120 of an array of antenna horns 121 relative to the printed circuit board 110 (FIG. 10, Block 1000) so that the antenna horn 120 circumscribes a respective printed circuit board launcher 610 of the printed circuit board 110. The antenna horn 120 of the array of antenna horns 121 is coupled to the printed circuit board 110 (FIG. 10, Block 1010) solely by coupling the plurality of compliant coupling members 210P, extending from the frame 200 of the antenna horn 120, and the respective receiving apertures 650 of the printed circuit board 110. Coupling the antenna horn 120 to the printed circuit board 110 includes coupling the antenna horn 120 to the printed circuit board 110 with a sub-lambda spacing between adjacent antenna horns 120 or any other suitable spacing. In one aspect, the sub-lambda spacing is less than about half a wavelength of the radio frequency signal 900 passing through the antenna horn 120. Coupling the plurality of compliant coupling members 210P and respective receiving apertures 650 of the printed circuit board 110 includes press-fitting the plurality of compliant coupling members 210P into the respective receiving apertures 650. In one aspect, the antenna horns 120 are configured for automated press-fit coupling with the printed circuit board 110. For example, the antenna horns 120 may be configured in any suitable manner so as to be gripped by a gripper of an automatic insertion machine 190, where the automatic insertion machine 190 positions the antenna horn 120 relative to printed circuit board 110 and couples (e.g., by press fitting) the antenna horn 120 with the printed circuit board 110. In other aspects, the antenna hors may be press fit to the printed circuit board in any suitable manner, such as manually. Coupling the antenna horn to the printed circuit board may also form the faraday cage 600, where the plurality of compliant coupling members 210P of the antenna horn 120 circumscribe the printed circuit board launcher 610, so that the faraday cage 600 substantially isolates radio frequency signals 900 to within the antenna horn 120. Radio frequency signal leakage may also be prevented from between the antenna horn 120 and the printed circuit board 110 with, e.g., the faraday cage 600 formed by the plurality of compliant coupling members 210P of the antenna horn 120 circumscribing the printed circuit board launcher 610. Radio frequency signal 900 interference between adjacent antenna horns 120 may also be substantially prevented with, e.g., the faraday cage 600 formed by the plurality of compliant coupling members 210P of the adjacent antenna horns 120.

The following examples are provided in accordance with the aspects of the present disclosure:

A1. An antenna horn for coupling with a printed circuit board, the antenna horn comprising:

a frame having at least one aperture forming a cup structure through which a radio frequency signal passes, the frame having a first end and a second end longitudinally spaced from the first end; and a plurality of compliant coupling members extending longitudinally from the first end, the plurality of compliant coupling members being configured to couple with respective receiving apertures of the printed circuit board such that coupling of plurality of compliant coupling members and the respective receiving apertures solely couples the antenna horn to the printed circuit board.

A2. The antenna horn of paragraph A1, wherein each of the plurality of compliant coupling members is configured so as to be press fit into a respective receiving aperture of the printed circuit board.

A3. The antenna horn of paragraph A1, wherein the frame comprises a gain antenna horn element formed by the at least one aperture.

A4. The antenna horn of paragraph A1, wherein the frame comprises a waveguide horn element formed by the at least one aperture.

A5. The antenna horn of paragraph A1, wherein the at least one aperture comprises at least two apertures that form respective waveguide horn elements arranged adjacent one another, the plurality of compliant coupling members being disposed between adjacent waveguide horn elements and, when coupled to the respective receiving apertures of the printed circuit board, substantially provide radio frequency signal isolation between the adjacent waveguide horn elements.

A6. The antenna horn of paragraph A5, wherein the frame forms a gain antenna horn element that is common to the at least two waveguide horn elements.

A7. The antenna horn of paragraph A1, wherein the plurality of compliant coupling members are integrally formed with the frame.

A8. The antenna horn of paragraph A1, wherein the plurality of compliant coupling members comprise compliant pins configured to exert an outward retention force against a wall of the respective receiving apertures.

A9. The antenna horn of paragraph A1, wherein the plurality of compliant coupling members comprise compliant pins having a surface roughness configured to grip a wall of the respective receiving aperture.

A10. The antenna horn of paragraph A1, wherein the plurality of compliant coupling members circumscribe the at least one aperture so as to, when coupled to the printed circuit board, form a faraday cage that substantially isolates radio frequency signals to within a respective aperture of the at least one aperture.

A11. The antenna horn of paragraph A1 (or A10), wherein the plurality of compliant coupling members circumscribe the at least one aperture so as to, when coupled to the printed circuit board, substantially prevent radio frequency signal leakage from between the frame and the printed circuit board.

A12. The antenna horn of paragraph A1, wherein the antenna horn is configured as a high density phase array antenna horn where a center to center spacing between adjacent antenna horns, from center to center, on the printed circuit board is a sub-lambda spacing.

A13. The antenna horn of paragraph A12, wherein the sub-lambda spacing is less than about half a wavelength of the radio frequency signal passing through the antenna horn.

A14. The antenna horn of paragraph A1, wherein the antenna horn is configured for automated press-fit coupling with the printed circuit board.

A15. The antenna horn of paragraph A1, wherein the plurality of compliant coupling members are configured to form a radio frequency ground coupling between the frame and the printed circuit board.

B1. An antenna array comprising:

a printed circuit board having a plurality of printed circuit board launchers; and an array of antenna horns configured to couple with the printed circuit board, one or more antenna horns of the array of antenna horns includes a frame having at least one aperture forming a cup structure that circumscribes a respective printed circuit board launcher, the frame having a first end coupled to the printed circuit board and a second end longitudinally spaced from the first end and extending from the printed circuit board; and a plurality of compliant coupling members extending longitudinally from the first end, the plurality of compliant coupling members being coupled with respective receiving apertures of the printed circuit board such that coupling of plurality of compliant coupling members and the respective receiving apertures solely couples the one or more antenna horns to the printed circuit board.

B2. The antenna array of paragraph B1, wherein each of the plurality of compliant coupling members is configured so as to be press fit into a respective receiving aperture of the printed circuit board.

B3. The antenna array of paragraph B1, wherein the frame comprises a gain antenna horn element formed by the at least one aperture.

B4. The antenna array of paragraph B1, wherein the frame comprises a waveguide horn element formed by the at least one aperture.

B5. The antenna array of paragraph B1, wherein the at least one aperture comprises at least two apertures that form respective waveguide horn elements arranged adjacent one another, the plurality of compliant coupling members being disposed between adjacent waveguide horn elements and effect radio frequency signal isolation between the adjacent waveguide horn elements.

B6. The antenna array of paragraph B5, wherein the frame forms a gain antenna horn element that is common to the at least two waveguide horn elements.

B7. The antenna array of paragraph B1, wherein the plurality of compliant coupling members are integrally formed with the frame.

B8. The antenna array of paragraph B1, wherein the plurality of compliant coupling members comprise compliant pins configured to exert an outward retention force against a wall of the respective receiving apertures.

B9. The antenna array of paragraph B1, wherein the plurality of compliant coupling members comprise compliant pins having a surface roughness configured to grip a wall of the respective receiving aperture.

B10. The antenna array of paragraph B1, wherein the plurality of compliant coupling members, coupled to the printed circuit board, circumscribe the at least one aperture so as to form a faraday cage that substantially isolates radio frequency signals to within a respective aperture of the at least one aperture.

B11. The antenna array of paragraph B1 (or B10), wherein the plurality of compliant coupling members coupled to the printed circuit board circumscribe the at least one aperture so as to substantially prevent radio frequency signal leakage from between the frame and the printed circuit board.

B12. The antenna array of paragraph B1, wherein the plurality of compliant coupling members circumscribe the respective printed circuit board launcher so as to form a faraday cage that substantially isolates radio frequency signals to within a respective antenna horn.

B13. The antenna array of paragraph B1 (or B10), wherein the plurality of compliant coupling members circumscribe the respective printed circuit board launcher so as to substantially prevent radio frequency signal leakage from between the frame and the printed circuit board.

B14. The antenna array of paragraph B1 (or B10), wherein the plurality of compliant coupling members circumscribe the respective printed circuit board launcher so as to substantially prevent radio frequency signal interference between adjacent antenna horns.

B15. The antenna array of paragraph B1, wherein the one or more antenna horns is configured as a high density phase array antenna horn where a center to center spacing between adjacent antenna horns is a sub-lambda spacing.

B16. The antenna array of paragraph B15, wherein the sub-lambda spacing is less than about half a wavelength of a radio frequency signal passing through the antenna horn.

B17. The antenna array of paragraph B1, wherein the one or more antenna horns is configured for automated press-fit coupling with the printed circuit board.

B18. The antenna array of paragraph B1, wherein the plurality of compliant coupling members are configured to form a radio frequency ground coupling between the frame and the printed circuit board.

B19. The antenna array of paragraph B1, wherein one or more of the plurality of printed circuit board launchers comprises a dual polarization launcher.

B20. The antenna array of paragraph B19, wherein the at least one aperture comprises two apertures, a first of the two apertures forms a first waveguide horn element for a first polarization element of the dual polarization launcher and a second of the two apertures forms a second waveguide horn element for a second polarization element of the dual polarization launcher.

B21. The antenna array of paragraph B20, wherein one or more of the plurality of compliant coupling members are disposed between the first waveguide horn element and the second waveguide horn element to isolate the first polarization element and the second polarization element.

B22. The antenna array of paragraph B1, wherein one or more of the plurality of printed circuit board launchers comprises a single polarization launcher.

B23. The antenna array of paragraph B1, wherein a distance between second ends of adjacent antenna horns of the one or more antenna horns prevents access to the first ends of the adjacent antenna horns at the printed circuit board.

B24. The antenna array of paragraph B1, wherein the plurality of compliant coupling members is configured to deform under an influence of the respective receiving apertures.

C1. A method for forming an antenna array, the method comprises:

positioning an antenna horn of an array of antenna horns relative to a printed circuit board so that the antenna horn circumscribes a respective printed circuit board launcher of the printed circuit board; and coupling the antenna horn of the array of antenna horns to the printed circuit board solely by coupling a plurality of compliant coupling members, extending from a frame of the antenna horn, and respective receiving apertures of the printed circuit board.

C2. The method of paragraph C1, wherein coupling the plurality of compliant coupling members and respective receiving apertures of the printed circuit board includes press-fitting the plurality of compliant coupling members into the respective receiving apertures.

C3. The method of paragraph C1, further comprising, effecting with an automatic insertion machine, positioning the antenna horn relative to printed circuit board and coupling the antenna horn with the printed circuit board.

C4. The method of paragraph C1, further comprising substantially preventing radio frequency signal leakage from between the antenna horn and the printed circuit board with the plurality of compliant coupling members of a respective antenna horn circumscribing the respective printed circuit board launcher.

C5. The method of paragraph C1, further comprising forming a faraday cage, with the plurality of compliant coupling members of a respective antenna horn circumscribing the respective printed circuit board launcher, wherein the faraday cage substantially isolates radio frequency signals to within the respective antenna horn.

C6. The method of paragraph C1, further comprising substantially preventing radio frequency signal interference between adjacent antenna horns with the plurality of compliant coupling members of the adjacent antenna horns.

C7. The method of paragraph C1, wherein coupling the antenna horn to the printed circuit board includes coupling the antenna horn to the printed circuit board with a sub-lambda spacing between adjacent antenna horns.

C8. The method of paragraph C7, wherein the sub-lambda spacing is less than about half a wavelength of a radio frequency signal passing through the antenna horn.

D1. An antenna comprising:

a printed circuit board having one or more printed circuit board launcher; and one or more antenna horns configured to couple with the printed circuit board, an antenna horn of the one or more antenna horn includes a frame having at least one aperture forming a cup structure that circumscribes a respective printed circuit board launcher, the frame having a first end coupled to the printed circuit board and a second end longitudinally spaced from the first end and extending from the printed circuit board; and a plurality of compliant coupling members extending longitudinally from the first end, the plurality of compliant coupling members being coupled with respective receiving apertures of the printed circuit board such that coupling of plurality of compliant coupling members and the respective receiving apertures solely couples the antenna horn to the printed circuit board.

D2. The antenna of paragraph D1, wherein each of the plurality of compliant coupling members is configured so as to be press fit into a respective receiving aperture of the printed circuit board.

D3. The antenna of paragraph D1, wherein the frame comprises a gain antenna horn element formed by the at least one aperture.

D4. The antenna of paragraph D1, wherein the frame comprises a waveguide horn element formed by the at least one aperture.

D5. The antenna of paragraph D1, wherein the at least one aperture comprises at least two apertures that form respective waveguide horn elements arranged adjacent one another, the plurality of compliant coupling members being disposed between adjacent waveguide horn elements and effect radio frequency signal isolation between the adjacent waveguide horn elements.

D6. The antenna of paragraph D5, wherein the frame forms a gain antenna horn element that is common to the at least two waveguide horn elements.

D7. The antenna of paragraph D1, wherein the plurality of compliant coupling members are integrally formed with the frame.

D8. The antenna of paragraph D1, wherein the plurality of compliant coupling members comprise compliant pins configured to exert an outward retention force against a wall of the respective receiving apertures.

D9. The antenna of paragraph D1, wherein the plurality of compliant coupling members comprise compliant pins having a surface roughness configured to grip a wall of the respective receiving aperture.

D10. The antenna of paragraph D1, wherein the plurality of compliant coupling members, coupled to the printed circuit board, circumscribe the at least one aperture so as to form a faraday cage that substantially isolates radio frequency signals to within a respective aperture of the at least one aperture.

D11. The antenna of paragraph D1 (or D10), wherein the plurality of compliant coupling members coupled to the printed circuit board circumscribe the at least one aperture so as to substantially prevent radio frequency signal leakage from between the frame and the printed circuit board.

D12. The antenna of paragraph D1, wherein the plurality of compliant coupling members circumscribe the respective printed circuit board launcher so as to form a faraday cage that substantially isolates radio frequency signals to within a respective antenna horn.

D13. The antenna of paragraph D1 (or D10), wherein the plurality of compliant coupling members circumscribe the respective printed circuit board launcher so as to substantially prevent radio frequency signal leakage from between the frame and the printed circuit board.

D14. The antenna of paragraph D1 (or D10), wherein the plurality of compliant coupling members circumscribe the respective printed circuit board launcher so as to substantially prevent radio frequency signal interference between adjacent antenna horns.

D15. The antenna of paragraph D1, wherein the antenna horn of the one or more antenna horns is configured as a high density phase array antenna horn where a center to center spacing between adjacent antenna horns is a sub-lambda spacing.

D16. The antenna of paragraph 15, wherein the sub-lambda spacing is less than about half a wavelength of a radio frequency signal passing through the antenna horn.

D17. The antenna of paragraph D1, wherein the one or more antenna horns are configured for automated press-fit coupling with the printed circuit board.

D18. The antenna of paragraph D1, wherein the plurality of compliant coupling members are configured to form a radio frequency ground coupling between the frame and the printed circuit board.

D19. The antenna of paragraph D1, wherein the one or more printed circuit board launcher comprises a dual polarization launcher.

D20. The antenna of paragraph D19, wherein the at least one aperture comprises two apertures, a first of the two apertures forms a first waveguide horn element for a first polarization element of the dual polarization launcher and a second of the two apertures forms a second waveguide horn element for a second polarization element of the dual polarization launcher.

D21. The antenna of paragraph D20, wherein one or more of the plurality of compliant coupling members are disposed between the first waveguide horn element and the second waveguide horn element to isolate the first polarization element and the second polarization element.

D22. The antenna of paragraph D1, wherein the one or more printed circuit board launcher comprises a single polarization launcher.

D23. The antenna of paragraph D1, wherein a distance between second ends of adjacent antenna horns of the one or more antenna horns prevents access to the first ends of the adjacent antenna horns at the printed circuit board.

D24. The antenna of paragraph D1, wherein the plurality of compliant coupling members is configured to deform under an influence of the respective receiving apertures.

E1. A method for forming an antenna, the method comprises:

positioning an antenna horn relative to a printed circuit board so that the antenna horn circumscribes a printed circuit board launcher of the printed circuit board; and coupling the antenna horn to the printed circuit board solely by coupling a plurality of compliant coupling members, extending from a frame of the antenna horn, and respective receiving apertures of the printed circuit board.

E2. The method of paragraph E1, wherein coupling the plurality of compliant coupling members and respective receiving apertures of the printed circuit board includes press-fitting the plurality of compliant coupling members into the respective receiving apertures.

E3. The method of paragraph E1, further comprising, effecting with an automatic insertion machine, positioning the antenna horn relative to printed circuit board and coupling the antenna horn with the printed circuit board.

E4. The method of paragraph E1, further comprising substantially preventing radio frequency signal leakage from between the antenna horn and the printed circuit board with the plurality of compliant coupling members of the antenna horn circumscribing the printed circuit board launcher.

E5. The method of paragraph E1, further comprising forming a faraday cage, with the plurality of compliant coupling members of the antenna horn circumscribing the printed circuit board launcher, wherein the faraday cage substantially isolates radio frequency signals to within the antenna horn.

In the figures, referred to above, solid lines, if any, connecting various elements and/or components may represent mechanical, electrical, fluid, optical, electromagnetic, wireless and other couplings and/or combinations thereof. As used herein, "coupled", "coupling", and other grammatical variants of the word "couple" means associated directly as well as indirectly. For example, a member A may be directly associated with a member B, or may be indirectly associated therewith, e.g., via another member C. It will be understood that not all relationships among the various disclosed elements are necessarily represented. Accordingly, couplings other than those depicted in the drawings may also exist. Dashed lines, if any, connecting blocks designating the various elements and/or components represent couplings similar in function and purpose to those represented by solid lines; however, couplings represented by the dashed lines may either be selectively provided or may relate to alternative examples of the present disclosure. Likewise, elements and/or components, if any, represented with dashed lines, indicate alternative examples of the present disclosure. One or more elements shown in solid and/or dashed lines may be omitted from a particular example without departing from the scope of the present disclosure. Environmental elements, if any, are represented with dotted lines. Virtual (imaginary) elements may also be shown for clarity. Those skilled in the art will appreciate that some of the features illustrated in the figures, may be combined in various ways without the need to include other features described in the figures, other drawing figures, and/or the accompanying disclosure, even though such combination or combinations are not explicitly illustrated herein. Similarly, additional features not limited to the examples presented, may be combined with some or all of the features shown and described herein.

In FIG. 10, referred to above, the blocks may represent operations and/or portions thereof and lines connecting the various blocks do not imply any particular order or dependency of the operations or portions thereof. Blocks represented by dashed lines, if any, indicate alternative operations and/or portions thereof. Dashed lines, if any, connecting the various blocks represent alternative dependencies of the operations or portions thereof. It will be understood that not all dependencies among the various disclosed operations are necessarily represented. FIG. 10 and the accompanying disclosure describing the operations of the method(s) set forth herein should not be interpreted as necessarily determining a sequence in which the operations are to be performed. Rather, although one illustrative order is indicated, it is to be understood that the sequence of the operations may be modified when appropriate. Accordingly, certain operations may be performed in a different order or substantially simultaneously. Additionally, those skilled in the art will appreciate that not all operations described need be performed.

In the foregoing description, numerous specific details are set forth to provide a thorough understanding of the disclosed concepts, which may be practiced without some or all of these particulars. In other instances, details of known devices and/or processes have been omitted to avoid unnecessarily obscuring the disclosure. While some concepts will be described in conjunction with specific examples, it will be understood that these examples are not intended to be limiting.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

Reference herein to "one example" means that one or more feature, structure, or characteristic described in connection with the example is included in at least one implementation. The phrase "one example" in various places in the specification may or may not be referring to the same example.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

Different examples of the apparatus(es) and method(s) disclosed herein include a variety of components, features, and functionalities. It should be understood that the various examples of the apparatus(es), system(s), and method(s) disclosed herein may include any of the components, features, and functionalities of any of the other examples of the apparatus(es) and method(s) disclosed herein in any combination, and all of such possibilities are intended to be within the scope of the present disclosure.

Many modifications of examples set forth herein will come to mind to one skilled in the art to which the present disclosure pertains having the benefit of the teachings presented in the foregoing descriptions and the associated drawings.

Therefore, it is to be understood that the present disclosure is not to be limited to the specific examples illustrated and that modifications and other examples are intended to be included within the scope of the appended claims. Moreover, although the foregoing description and the associated drawings describe examples of the present disclosure in the context of certain illustrative combinations of elements and/or functions, it should be appreciated that different combinations of elements and/or functions may be provided by alternative implementations without departing from the scope of the appended claims. Accordingly, parenthetical reference numerals in the appended claims are presented for illustrative purposes only and are not intended to limit the scope of the claimed subject matter to the specific examples provided in the present disclosure.

What is claimed is:

1. An antenna array comprising:

a printed circuit board having a plurality of printed circuit board launchers; and an array of antenna horns configured to couple with the printed circuit board, one or more antenna horns of the array of antenna horns includes a frame having at least one aperture forming a cup structure that circumscribes a respective printed circuit board launcher, the frame having a first end coupled to the printed circuit board and a second end longitudinally spaced from the first end and extending from the printed circuit board, and a plurality of compliant coupling members extending longitudinally from the first end, the plurality of compliant coupling members being coupled with respective receiving apertures of the printed circuit board such that coupling of plurality of compliant coupling members and the respective receiving apertures solely couples the one or more antenna horns to the printed circuit board.

2. The antenna array of claim 1, wherein each of the plurality of compliant coupling members is configured so as to be press fit into a respective receiving aperture of the printed circuit board.

3. The antenna array of claim 1, wherein the plurality of compliant coupling members comprise compliant pins configured to exert an outward retention force against a wall of the respective receiving apertures.

4. The antenna array of claim 1, wherein the plurality of compliant coupling members circumscribe the respective printed circuit board launcher so as to form a faraday cage that substantially isolates radio frequency signals to within a respective antenna horn.

5. The antenna array of claim 1, wherein the plurality of compliant coupling members circumscribe the respective printed circuit board launcher so as to substantially prevent radio frequency signal leakage from between the frame and the printed circuit board.

6. The antenna array of claim 1, wherein the plurality of compliant coupling members circumscribe the respective printed circuit board launcher so as to substantially prevent radio frequency signal interference between adjacent antenna horns.

7. The antenna array of claim 1, wherein the one or more antenna horns is configured as a high density phase array antenna horn where a center to center spacing between adjacent antenna horns is a sub-lambda spacing.

8. The antenna array of claim 1, wherein the plurality of compliant coupling members are configured to form a radio frequency ground coupling between the frame and the printed circuit board.

9. The antenna array of claim 1, wherein a distance between second ends of adjacent antenna horns of the one or more antenna horns prevents access to the first ends of the adjacent antenna horns at the printed circuit board.

10. An antenna horn for coupling with a printed circuit board, the antenna horn comprising:

a frame having at least one aperture forming a cup structure through which a radio frequency signal passes, the frame having a first end and a second end longitudinally spaced from the first end; and a plurality of compliant coupling members extending longitudinally from the first end, the plurality of compliant coupling members being configured to couple with respective receiving apertures of the printed circuit board such that coupling of plurality of compliant coupling members and the respective receiving apertures solely couples the antenna horn to the printed circuit board.

11. The antenna horn of claim 10, wherein each of the plurality of compliant coupling members is configured so as to be press fit into a respective receiving aperture of the printed circuit board.

12. The antenna horn of claim 10, wherein the plurality of compliant coupling members circumscribe the at least one aperture so as to, when coupled to the printed circuit board, form a faraday cage that substantially isolates radio frequency signals to within a respective aperture of the at least one aperture.

13. The antenna horn of claim 10, wherein the plurality of compliant coupling members circumscribe the at least one aperture so as to, when coupled to the printed circuit board, substantially prevent radio frequency signal leakage from between the frame and the printed circuit board.

14. The antenna horn of claim 10, wherein the antenna horn is configured as a high density phase array antenna horn where a center to center spacing between adjacent antenna horns, from center to center, on the printed circuit board is a sub-lambda spacing.

15. The antenna horn of claim 10, wherein the antenna horn is configured for automated press-fit coupling with the printed circuit board.

16. The antenna horn of claim 10, wherein the plurality of compliant coupling members are configured to form a radio frequency ground coupling between the frame and the printed circuit board.

17. A method for forming an antenna array, the method comprises:

positioning an antenna horn of an array of antenna horns relative to a printed circuit board so that the antenna horn circumscribes a respective printed circuit board launcher of the printed circuit board; and coupling the antenna horn of the array of antenna horns to the printed circuit board solely by coupling a plurality of compliant coupling members, extending from a frame of the antenna horn, and respective receiving apertures of the printed circuit board.

18. The method of claim 17, wherein coupling the plurality of compliant coupling members and respective receiving apertures of the printed circuit board includes press-fitting the plurality of compliant coupling members into the respective receiving apertures.

19. The method of claim 17, further comprising, effecting with an automatic insertion machine, positioning the antenna horn relative to printed circuit board and coupling the antenna horn with the printed circuit board.

20. The method of claim 17, wherein coupling the antenna horn to the printed circuit board includes coupling the antenna horn to the printed circuit board with a sub-lambda spacing between adjacent antenna horns.

* * * * *